US010259131B2

(12) United States Patent
Krenik

(10) Patent No.: US 10,259,131 B2
(45) Date of Patent: Apr. 16, 2019

(54) USER INTERFACE AND MODELING TECHNIQUES FOR AUTOMATED HAIR CUTTING SYSTEM

(71) Applicant: Matthew W. Krenik, Garland, TX (US)

(72) Inventor: Matthew W. Krenik, Garland, TX (US)

( * ) Notice: Subject to any disclaimer, the term of this patent is extended or adjusted under 35 U.S.C. 154(b) by 341 days.

(21) Appl. No.: 14/614,615

(22) Filed: Feb. 5, 2015

(65) Prior Publication Data

US 2015/0217465 A1 Aug. 6, 2015

Related U.S. Application Data

(60) Provisional application No. 61/948,759, filed on Mar. 6, 2014, provisional application No. 61/936,536, filed on Feb. 6, 2014.

(51) Int. Cl.
*B26B 19/38* (2006.01)

(52) U.S. Cl.
CPC ..... *B26B 19/388* (2013.01)

(58) Field of Classification Search
CPC ... B26B 19/42; B26B 21/4081; B26B 19/388; B26B 19/3846; B26B 19/3806; Y10T 83/148; Y10T 83/0448; Y10T 83/04
USPC ..... 30/43.92
See application file for complete search history.

(56) References Cited

U.S. PATENT DOCUMENTS 2,972,351 A * 2/1961 Morgan ..... B26B 19/00 132/213
3,093,901 A * 6/1963 Wahl ..... B26B 19/205 30/201
3,233,614 A * 2/1966 Lefcoski ..... B26B 19/02 132/213
3,241,562 A * 3/1966 Gronier ..... B26B 19/00 132/213
3,413,985 A * 12/1968 Dlouhy ..... A45D 44/06 132/213
3,570,500 A * 3/1971 Berry ..... B26B 19/00 132/213

(Continued)

OTHER PUBLICATIONS

Amazon.com Recommendations. Linden, Smith, and York. https://www.cs.umd.edu/~samir/498/Amazon-Recommendations.pdf.*

*Primary Examiner* — Sean M Michalski
(74) *Attorney, Agent, or Firm* — Richard Eldredge

(57) ABSTRACT

Embodiments of automated hair cutting systems and user interfaces for use therewith are disclosed herein. In one embodiment, an automated hair cutting system comprises a hair cutting device, the hair cutting device comprising a cutter head and at least one sensor, the sensor configured for determining orientation of the hair cutting device; a user interface for providing information to and receiving input from a user, wherein at least one input received from the user is a desired hair style; components configured for measuring hair thickness; components configured for mapping a user's head configuration and determining hair orientation; and a processor configured to prepare a hair cutting algorithm for the automated hair cutting system based on input received from the user, the at least one sensor, and one or more components configured for mapping at least one of a user's head configuration, hair thickness, and hair orientation.

22 Claims, 20 Drawing Sheets

(56) References Cited

U.S. PATENT DOCUMENTS 3,577,642 A * 5/1971 Tripoli ..... G01B 13/08 33/549
3,626,195 A * 12/1971 Fitzjohn ..... G01B 7/12 250/233
4,195,250 A * 3/1980 Yamamoto ..... G01B 7/008 318/561
4,249,062 A * 2/1981 Hozumi ..... B23K 9/12 219/124.22
4,279,594 A * 7/1981 Rigutto ..... A61B 1/253 433/31
4,433,382 A * 2/1984 Cunningham ..... G05B 19/4083 700/186
4,486,843 A * 12/1984 Spongh ..... B25J 9/1661 318/568.14
4,602,542 A * 7/1986 Natrasevschi ..... B26B 19/00 132/214
4,897,586 A * 1/1990 Nakata ..... G05B 19/42 318/568.16
5,153,994 A * 10/1992 Emmett ..... B26B 19/06 30/133
5,240,107 A * 8/1993 Casale ..... B26B 21/4087 206/349
5,461,780 A * 10/1995 Morana ..... B26B 21/12 30/29.5
5,579,581 A * 12/1996 Melton ..... B26B 19/063 30/223
5,791,050 A * 8/1998 Masi ..... B26B 19/38 30/296.1
5,794,348 A * 8/1998 Scott ..... B26B 21/12 30/195
5,865,192 A * 2/1999 Sealy ..... B26B 29/06 132/214
5,970,146 A * 10/1999 McCall ..... G06F 3/0416 345/173
6,836,700 B2 * 12/2004 Greene ..... B25J 9/1664 118/316
6,886,255 B2 * 5/2005 Freas ..... B26B 19/06 30/200
6,952,168 B2 * 10/2005 Recko, Jr. ..... G08B 3/10 340/331
7,298,535 B2 * 11/2007 Kuutti ..... G08B 21/182 359/13
7,415,767 B2 * 8/2008 Saker ..... B26B 21/38 30/34.05
7,870,496 B1 * 1/2011 Sherwani ..... H04L 67/38 715/718
8,104,178 B2 * 1/2012 Worgull ..... B26B 19/06 30/208
8,180,479 B2 * 5/2012 Xu ..... B26D 5/20 700/160
8,446,247 B2 * 5/2013 Allen ..... G01V 8/20 340/3.1
8,474,466 B2 * 7/2013 Lakin ..... B26B 19/00 132/213
8,571,722 B2 * 10/2013 Samples ..... G08G 1/168 701/1
8,651,160 B2 * 2/2014 Urabe ..... B25J 9/1682 156/250
8,702,426 B2 * 4/2014 Soto ..... G09B 19/0076 434/81
8,723,912 B2 * 5/2014 Michrowski ..... H04N 7/147 348/14.01
8,818,548 B2 * 8/2014 Aoki ..... A01D 34/828 340/680
8,928,747 B2 * 1/2015 Burdoucci ..... A45D 44/005 348/61
9,084,891 B2 * 7/2015 Aberizk ..... B26B 19/42
9,289,129 B2 * 3/2016 Yin ..... A61B 5/0077
2002/0119428 A1 * 8/2002 Vitale ..... A45D 24/36 434/94
2005/0244057 A1 * 11/2005 Ikeda ..... A45D 44/005 382/181
2005/0273109 A1 * 12/2005 Bjork ..... A61B 17/1626 606/80
2007/0220754 A1 * 9/2007 Barbaro ..... A45D 27/22 30/41
2008/0175448 A1 * 7/2008 Fujiwara ..... G06K 9/00208 382/118
2009/0303320 A1 * 12/2009 Davis ..... H04N 7/181 348/77
2010/0026717 A1 * 2/2010 Sato ..... A45D 44/005 345/642
2010/0122614 A1 * 5/2010 Waterman ..... B08B 9/0808 83/360
2010/0186234 A1 * 7/2010 Binder ..... A45D 26/00 30/34.05
2011/0018985 A1 * 1/2011 Zhu ..... A45D 44/00 348/61
2014/0182138 A1 * 7/2014 Krenik ..... B26B 19/3806 30/123

* cited by examiner

USER INTERFACE AND MODELING TECHNIQUES FOR AUTOMATED HAIR CUTTING SYSTEM

CLAIM OF PRIORITY AND CROSS REFERENCE TO RELATED APPLICATION

This application claims the benefit of U.S. Provisional Application Ser. No. 61/936,536, filed by Matthew W. Krenik on Feb. 6, 2014 and entitled "User Interface for Automated Hair Cutting System", and U.S. Provisional Application Ser. No. 61/948,759, filed by Matthew W. Krenik on Mar. 6, 2014 and entitled "User Interface and Modeling Techniques for Automated Hair Cutting System", commonly owned with this application and incorporated herein by reference.

TECHNICAL FIELD

This application is directed, in general, to user interfaces for automated hair cutting systems and, more specifically, to a user interface that receives measurements and input from a user in order to provide a map of a person's scalp for cutting the person's hair.

BACKGROUND

International application number PCT/US12/70856, filed by Matthew W. Krenik on Dec. 20, 2012, entitled "Automated Hair Cutting System and Method of Operation Thereof," (hereinafter "Krenik '856") provides a description of automated hair cutting systems. These systems operate by determining the position and/or orientation of a hair cutting device relative to a user receiving a haircut. Hair may be collected in a cutter head and extended for cutting to a beneficial length. Through electronic measurements and computational analysis, the location of where hair on the scalp of a user is collected into a cutter head may be determined and as hair is extended and slides through a cutter head, its length may be substantially determined so that a cutter head may be actuated at a beneficial time to cut hair to a beneficial length.

Krenik '856 identifies multiple ways that an automated hair cutting system may be utilized to cut hair and achieve beneficial results. In doing so, Krenik '856 illustrates multiple ways that automated hair cutting systems may be applied to cut hair so that a wider range of styles, more desirable results, or other benefits may be achieved in providing a user with a desirable haircut. In turn, there are benefits of a user interface that allows hair styles to be easily viewed, selected, modeled, modified, and stored for future use. Further benefits may also be provided by recommending products, such as hair care products, cosmetics, or other products to users for purchase based on information learned about a user in the course of using an automated hair cutting system.

U.S. patent application Ser. No. 14/051,201 filed by Matthew W. Krenik on Oct. 10, 2013, entitled "Cutter Head for Automated Hair Cutting System," (hereinafter "Krenik '201") provides embodiments of cutter heads suitable for use with automated hair cutting systems. The embodiments of hair cutting devices shown in the present disclosure may utilize the cutter heads shown in Krenik '201, the cutter heads described in the present disclosure, or other suitable cutter heads.

U.S. patent application Ser. No. 14/086,497 filed by Matthew W. Krenik on Nov. 21, 2013, entitled "Sensing and Control Techniques for Automated Hair Cutting System," (hereinafter "Krenik '497") provides embodiments of sensing, actuation, and control systems for cutter heads for automated hair cutting systems. The embodiments of hair cutting devices shown in the present disclosure may utilize the sensing, actuation, and control systems shown in Krenik '497, those described in the present disclosure, or other suitable sensing, actuation, and control systems.

U.S. patent application Ser. No. 14/143,469 filed by Matthew W. Krenik on Dec. 30, 2013, entitled "Hair Cutting Device for Automated Hair Cutting System," (hereinafter "Krenik '469") provides embodiments of hair cutting devices for automated hair cutting systems. The embodiments of hair cutting devices shown in the present disclosure may utilize the embodiments shown in Krenik '469, those described in the present disclosure, or other suitable embodiments of hair cutting devices.

U.S. patent application Ser. No. 14/156,817 filed by Matthew W. Krenik on Jan. 16, 2014, entitled "Positioning Device for Automated Hair Cutting System," (hereinafter "Krenik '817") provides embodiments of positioning devices for automated hair cutting systems. The embodiments of positioning devices shown in the present disclosure may utilize the embodiments shown in Krenik '817, those described in the present disclosure, or other suitable embodiments of positioning devices. Some embodiments of automated hair cutting systems may not use a positioning device, and instead depend on use of other sensors, cameras, and other suitable techniques to determine the position and/or orientation of a hair cutting device relative to the head of a user.

SUMMARY

The present disclosure provides various embodiments of a user interface for use with an automated grooming system. In one embodiment, there is an apparatus for use with an automated hair cutting system, comprising a user interface for providing information to and receiving input from a user, wherein at least one input received from the user is a desired hair style; components configured for mapping at least one of a user's head configuration, hair thickness, and hair orientation; and a processor configured to prepare a hair cutting algorithm for the automated hair cutting system based on input received from the user and at least one of mapped head configuration, hair thickness, and hair orientation.

In another embodiment, there is disclosed a user interface for an automated hair cutting system, comprising a display for providing information to a user; an input interface for receiving input from a user, wherein at least one input received from the user is a desired hair style; and a processor, the processor configured to communicate with one or more components of the automated hair cutting system; and prepare a hair cutting algorithm for the automated hair cutting system based on input received from the user and input received from the one or more components of the automated hair cutting system, wherein the received inputs include at least one of hair thickness, the user's head configuration, and hair orientation.

In yet another embodiment, there is disclosed an automated hair cutting system comprising a hair cutting device, the hair cutting device comprising a cutter head and at least one sensor, the sensor configured for determining orientation of the hair cutting device; a user interface for providing information to and receiving input from a user, wherein at least one input received from the user is a desired hair style;

components configured for mapping at least one of a user's head configuration, hair thickness, and hair orientation; and a processor configured to prepare a hair cutting algorithm for the automated hair cutting system based on input received from the user, the at least one sensor, and at least one of hair thickness, the user's head configuration, and hair orientation.

In another embodiment, there is a method of cutting hair using an automated hair cutting system, the method comprising initiating a user interface of the automated hair cutting system, the user interface comprising a display for providing information to a user; an input interface for receiving input from a user; and a processor, the processor configured to communicate with one or more components of the automated hair cutting system; and preparing a hair cutting algorithm for the automated hair cutting system based on input received from the user and input received from the one or more components of the automated hair cutting system. The user then selects, models, and customizes a hair style through the user interface, wherein modeling and customizing the hair style includes inputting information about the user's hair and head into the user interface and then receiving inputs from the one or more components of the automated hair cutting system, the received inputs including at least one of measured hair thickness, the user's head configuration, and hair orientation. The processor thereafter prepares the hair cutting algorithm according to the customized hair style, and initiates a cutting head of the automated hair cutting system to cut the user's hair. In some embodiments, the method may further comprise the user reviewing their hair after hair cutting and further modifying the hair style.

DETAILED DESCRIPTION

Figure 1:
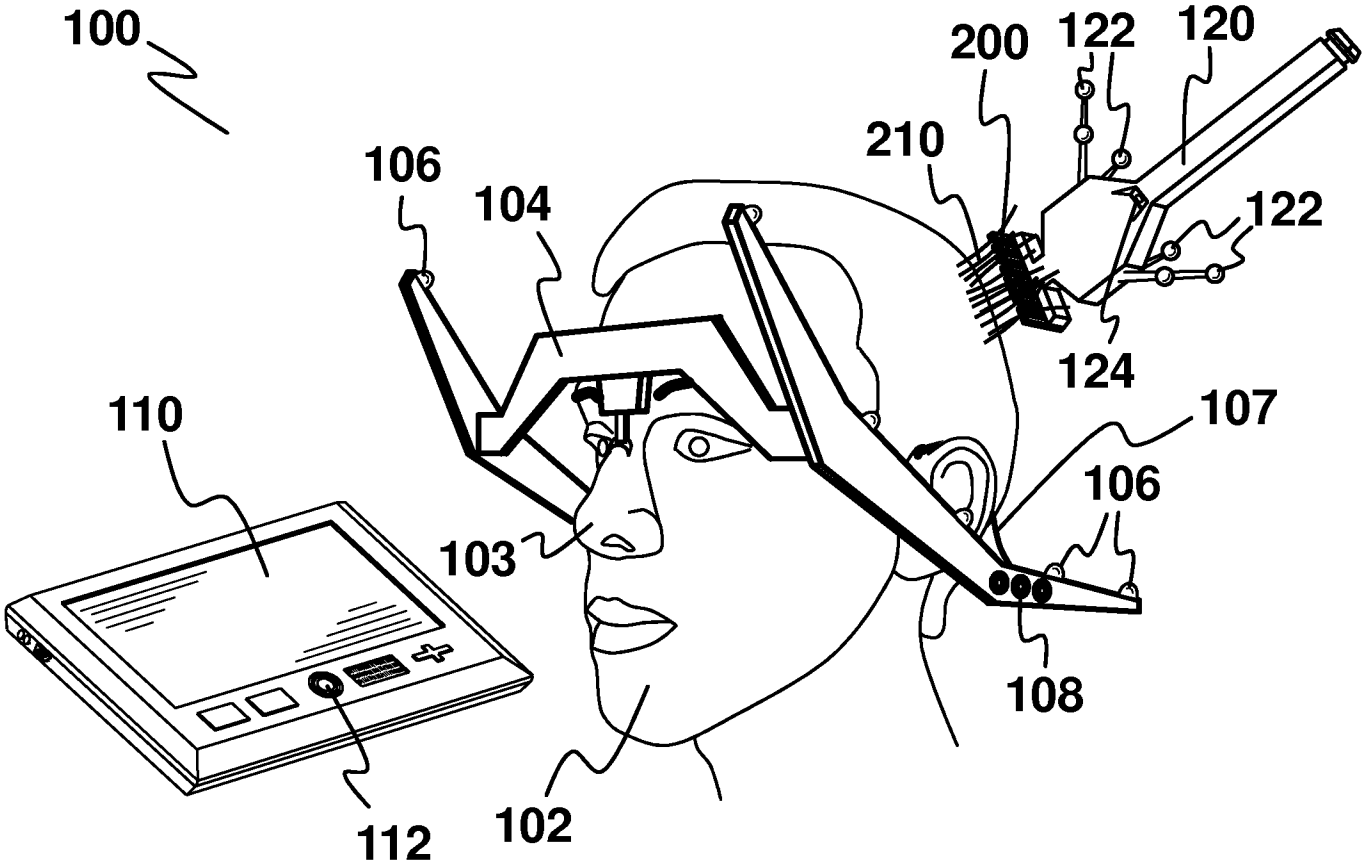
FIG. 1 shows an environmental view of an embodiment of an automated hair cutting system according to the present disclosure.

The present disclosure provides enhanced systems, techniques, and methods for a user interface for an automated hair cutting system. Embodiments may include user interfaces that allow a user to select a hair style from a touch screen interface on an electronic computing device or from other electronic computer systems. Styles may be modeled so that they appear on an electronic display substantially as they would appear on the user once their haircut is completed, or drawings, illustrations or other images may be used instead of actual images of an actual user. Users may utilize computer interfaces to customize a hair style to their liking and may experiment with various style options and observe various views of a style before selecting it. Styles may be modeled based on information about a specific user's hair thickness, hair orientation, hair length, hair stiffness, hair curliness, and other factors so that results of haircuts may be predicted. The flow of both combed hair and the orientation and flow of hair from a user's scalp may be modeled and adjusted so that hair orientation is factored into modeling results. Additionally, hair thickness, curliness, existing hairstyle (including how it is combed, curled, straightened, styling gels applied, and other possible ways that hair may be manipulated, treated, or conditioned to create a style) and other aspects of hair may be taken into account in modeling a hair style.

Once a hair style has been selected and hair cutting has been completed, a user may observe their hair using a mirror, or possibly using a camera, or cameras included in an automated hair cutting system. Upon observing their hair, a user may make adjustments to their hair style again using an electronic computer interface. Multiple cycles of hair cutting and adjustment may be undertaken and results may be stored for future haircuts once a preferred result has been achieved. Some embodiments of automated hair cutting systems may offer users the opportunity to purchase hair care products, hair styling products, hair accessories, cosmetics, jewelry, clothing, appliances, and possibly other products. Product recommendations may be in the form of advertisements, offers for immediate purchases, or combinations of offers as may appeal to some users. For some embodiments, recommendations regarding various products a user may wish to purchase may be determined based on information learned about the user in the course of their use of an automated hair cutting system. Such information may include a user's age, sex, hair length, hair style interests, hair style preferences, skin color, hair color, preferred cosmetics, preferred hair care products, prior product purchases, and other information that may provide indications regarding a user's preferences, interests, lifestyle, wealth level, or other factors that may be helpful in making product recommendations to a user. In some embodiments, products recommended may be immediately purchased using an electronic computing device running user interface software.

Embodiments of this invention relate to improved user interfaces and hair modeling for automated hair cutting systems. These improved user interfaces may allow hair thickness measurements, hair orientation, head configuration, hair length measurements, and other information collected from an automated hair cutting system to be mapped to a user's scalp and allow hair styles to be modeled and displayed. In the present disclosure, a user's head configuration may include information relating to head size, shape, scalp outline, and/or other information available regarding a user's head or scalp. Head configuration information may be used when modeling hairstyles for a user. Hair may be modeled based on scalp maps or models that provide information about how a user intends to comb their hair, maps or models of the orientation at which hair emerges from a user's scalp, hair length maps, hair thickness maps, and other factors. A user may interact with various views of a hair style that may be provided on an electronic display and may make modifications to a hair style using a touch screen interface or other electronic interface to create a desired hair style. Desired styles may be mapped to a hair length map or model that may be used to represent a hair style for a hair cutting operation. Both two- and three-dimensional models of a user's scalp and hair may be utilized.

Now referring to the drawings, in FIG. 1, there is shown one embodiment of an automated hair cutting system 100 cutting a region of hair 210 on a user 102. Automated hair cutting system 100 comprises a hair cutting device 120 including a cutter head 200, electronic computing device 110 that may include a camera 112, and a positioning device 104 having a plurality of positioning interfaces 106. Positioning device 104 is supported on user 102 face via user's nose 103, ears, and possibly other facial features. Ear supports 107 on positioning device 104 may hook over ears from the back and may be inserted into ear support holes 108 to accommodate users 102 with larger or smaller (or differently shaped) heads. Hair cutting device 120 may include a camera 124. Hair cutting device 120, electronic computing device 110, and positioning device 104 may communicate and interact over wired or wireless interfaces not shown in FIG. 1. Hair cutting device 120 may be held and manipulated by user 102 or another person operating automated hair cutting system 100. Positioning signals may be generated and propagate between positioning interfaces 106 on positioning device 104 and sensors 122 on hair cutting device 120. Analysis of these positioning signals may allow automated hair cutting system 100 to determine the position and/or orientation of hair cutting device 120 relative to the head of user 102. Further, the positioning signals may be used by a processor comprising electronic computing device 110 during display to the user and preparing hair cutting instructions. Embodiments of automated hair cutting system 100 are described in more detail in Krenik '856. Hair cutting system 100 may operate through observation of and/or interaction with user 102 and/or positioning device 104 by hair cutting device 120 and/or other system elements to substantially allow the position and/or orientation of hair cutting device 120 to be determined relative to the head of user 102 so that selected regions of hair 210 may be substantially collected in a cutter head 200 of hair cutting device 120, extended to a beneficial length, and cut. Additional embodiments, modes of operation and additional description of automated hair cutting system 100 may be found in Krenik '856.

Electronic computing device 110 may comprise a display and one or more components for user interaction, such as, for example, an interactive touch screen, keyboard, and other components which may provide and receive information from a user. User 102 or other person operating, supporting, and manipulating hair cutting device 120 may respond to instructions, queues, or additional guidance or information from electronic computing device 110 or other elements of automated hair cutting system 100 in the course of a haircut. Instructions, queues, or additional guidance or information from electronic computing device 110 may be presented visually on a display of electronic computing device 110 or other electronic displays that may be available in some embodiments, may be in the form of audible sound signals, may come from indicator lights, may be haptic signals, or may be other possible signals user 102 may be able to receive and respond to. Hair cutting device 120 may also provide haptic signals. Some embodiments of automated hair cutting system 100 may include additional elements or additional features added to some of the elements shown in FIG. 1 that may provide other or additional signals to user 102.

Electronic computing device 110 and other components of automated hair cutting system 100 may include communication systems to facilitate communication and connection with the internet, wireless communication systems, other computing devices, printers, information systems, or other suitable systems. Automated hair cutting system 100 may collect and store information about user 102, including age, sex, hair style, hair color, hair type, personal preferences, and other information. Automated hair cutting system 100 may recommend hair care products, cosmetics, jewelry, and possibly other products to user 102 that may be purchased online, over the internet, through electronic computing device 110 or possibly through other elements of automated hair cutting system 100.

Figure 2A:
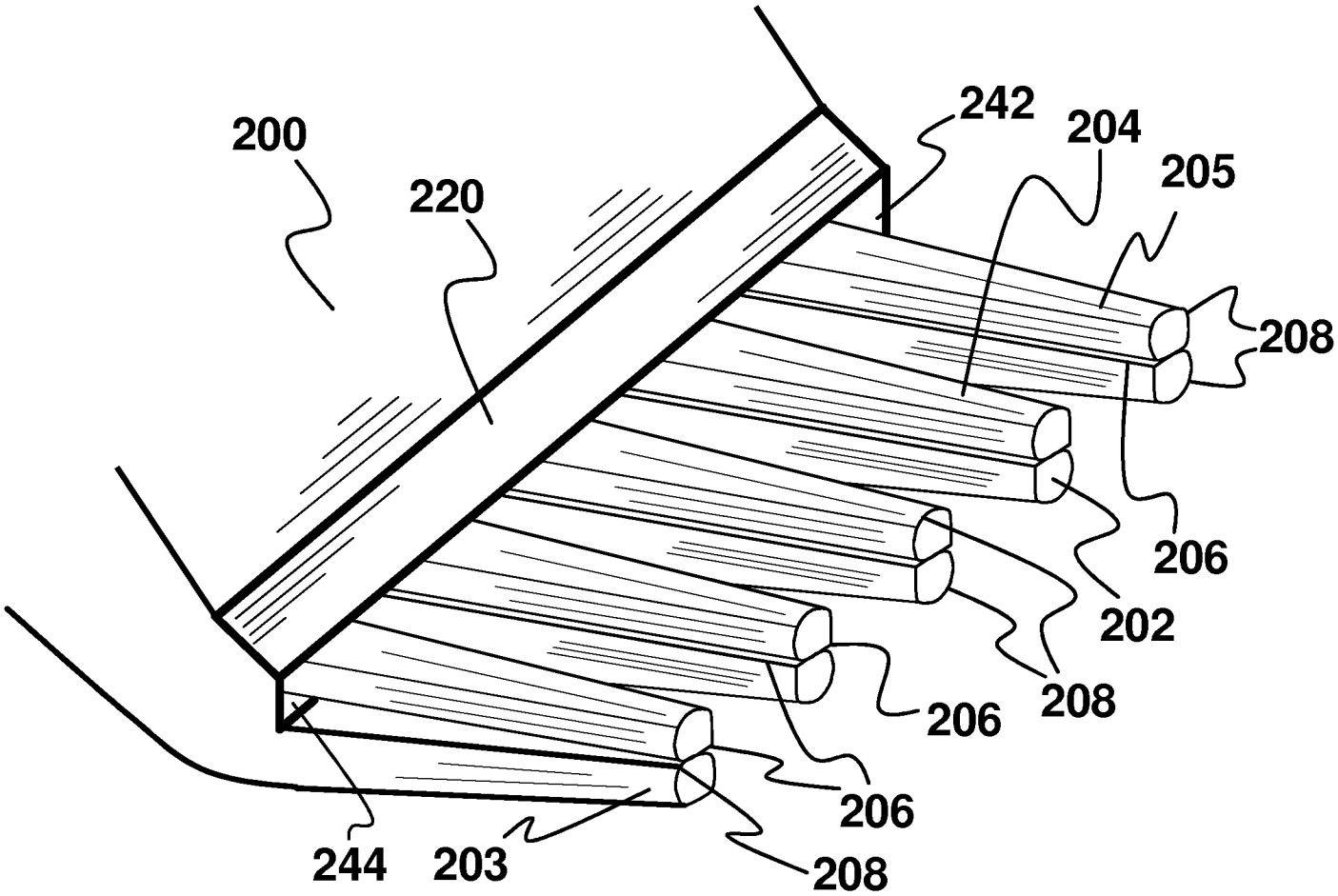
FIG. 2A shows a perspective view of an embodiment of a cutter head for use on a hair cutting device in an automated hair cutting system according to the present disclosure.

FIG. 2A shows an embodiment of cutter head 200 that may be used in hair cutting devices such as hair cutting device 120 that allows hair to be collected, allows actuation of the cutter knives 204 in a first direction to apply pressure and friction to hair so that it may be manipulated and extended, and provides cutting action when the cutter knives 204 are actuated in a second direction. Cutter head 200 of FIG. 2A comprises cutter knives 204, comb teeth 202, and body 220. Cutter head 200 may be actuated so that cutter knives 204 are substantially above comb teeth 202 so that hair may be collected in cutter head 200 (the view of FIG. 2A shows cutter knives 204 in such a position). Cutter head 200 may be actuated so that cutter knives 204 move to the left (toward the lower left corner of FIG. 2A) so that rounded edges 208 of cutter knives 204 and comb teeth 202 apply pressure to hair collected in cutter head 200. Application of pressure to hair collected into cutter head 200 may improve the ability to manipulate hair collected in cutter head 200 as the resulting friction may help to keep hair in cutter head 200 so that it is less likely to fall out. Cutter head 200 may be actuated so that cutter knives 204 move to the right (toward the upper right corner of FIG. 2A) so that sharp edges 206 of cutter knives 204 and comb teeth 202 meet and pass over each other to provide a cutting action (similar to handheld scissors). Left most comb tooth 203 and right most cutter knife 205 have only rounded edges 208 and have no sharp edges 206 as left most comb tooth 203 and right most cutter knife 205 are not utilized for cutting hair during a cutting stroke of cutter head 200. Gap 242 and gap 244 provide spacing between cutter knives 204 (including right most cutter knife 205) and body 220 so that they may move to the right and left. Cutter head 200 may be fabricated from metals, ceramics, glass, sapphire, and other suitable materials. In some embodiments, cutter knives 204 of cutter head 200 may be independently actuated so that they may cut hair collected between adjacent cutter knives 204 to different lengths; while in other embodiments cutter knives 204 may be actuated all together at the same time, or possibly actuated in groups. Cutter head 200 or other possible cutter head embodiments may be utilized on hair cutting device 120. Krenik '201 provides additional description of cutter heads similar to cutter head 200 and also describes additional embodiments of cutter heads suitable for some embodiments of hair cutting devices.

Figure 2B:
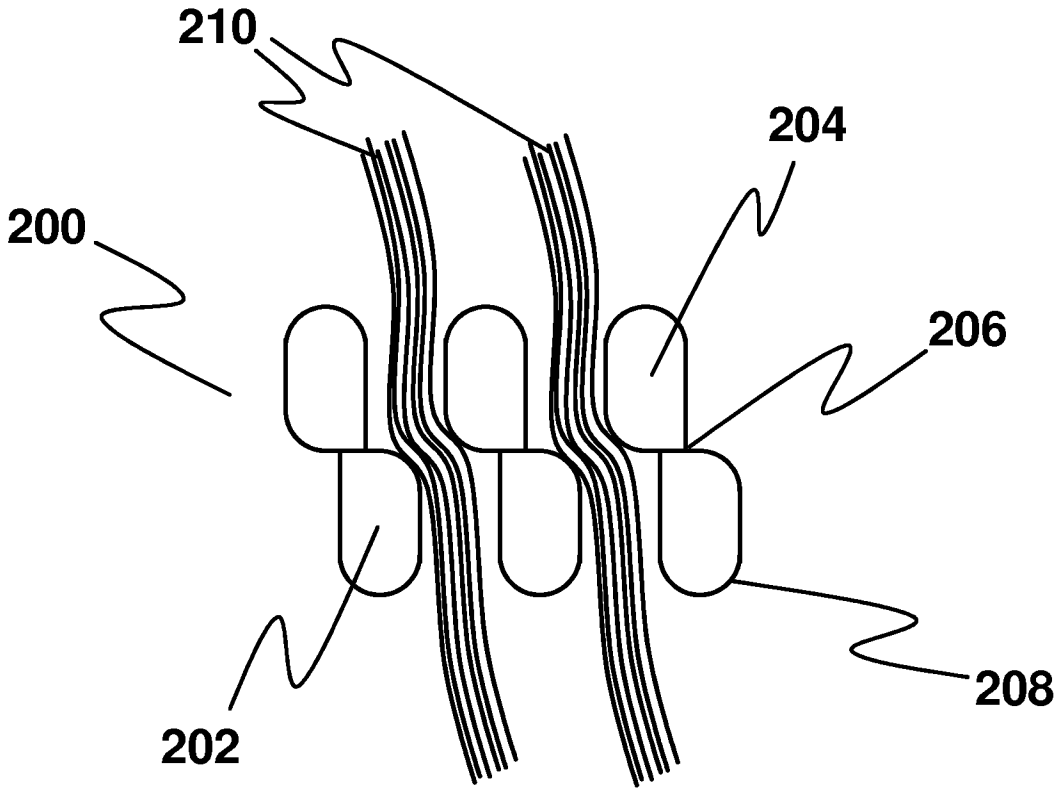
FIG. 2B shows a cross-section view of the cutter head shown in FIG. 2A, illustrating cutter knives and comb teeth thereof.

FIG. 2B shows a cross-sectional view of three cutter knives 204 and three comb teeth 202 of cutter head 200. The view of FIG. 2B is taken looking into the tips of the cutter knives 204 and comb teeth 202; that is, looking into cutter knives 204 and comb teeth 202 from the direction from which hair may enter cutter head 200. Hair 210 is shown collected in cutter head 200 and cutter knives 204 are shown actuated to the left relative to comb teeth 202 so that some level of pressure and friction is applied to hair 210 between rounded edges 208 of cutter knives 204 and comb teeth 202. As described in Krenik '497, the amount of hair 210 collected in cutter head 200 may be assessed by applying some level of pressure on hair 210 and monitoring the degree to which cutter knives 204 slide to the left relative to comb teeth 202. See Krenik '497 for more information on how cutter knives 204 may be actuated and how their motion may be sensed. As hair 210 is collected into cutter head 200, various instruments and components on cutter head 200 and hair cutting device 120 may be configured to measure hair collected therewith. Measurement of the amount of hair 210 collected in cutter head 200 allows the thickness of a user's 102 hair to be determined as function of location on their scalp. Thickness of a user's hair may be defined differently as a matter of convenience in various embodiments of automated hair cutting systems. In some possible embodiments, thickness of a user's hair may be measured by measuring the diameter of hairs on user's head and the number of hairs emanating from a fixed dimensioned area of a user's scalp. For example, one user may have fewer hairs over a square centimeter of their scalp but may have larger diameter hair, while another user may have smaller hair diameter but may have more hairs over a square centimeter of their scalp, so that each have similar hair thickness. Hair thickness may also be expressed as a percentage of the amount of solid hair mass over an area of the scalp. For example, over a square centimeter of scalp area, a specific user may have solid hair covering ten percent (10%) of the area and hair thickness may then be expressed as ten percent for that region of that user's scalp. Accordingly, if hair with ten percent thickness was collected over a square centimeter of scalp area and then squashed down to a solid mass, that mass would fill a tenth of a square centimeter of space. A wide range of measures may be applied to measurement of the thickness of hair. Various embodiments of automated hair cutting systems may define hair thickness or other measures of the density, mass, or other suitable measures of hair over a region of a user's scalp in different ways. Hair thickness, density, mass, or other suitable measures may be determined for various regions of a user's 102 scalp, as described above with regard to FIG. 2B, and mapped to user's 102 scalp so that an electronic reference map of hair thickness, density, mass, or other suitable measures over a user's 102 scalp may be generated.

Hair thickness may also be measured and provided as a function of distance from a user's 102 scalp (that is, thickness as a function of the distance from which the hair emerged from a user's scalp). User 102 may have tapered or thinned their hair so that their hair is thinner some distance above their scalp. Automated hair cutting system 100 may track the position of cutter head 200 with respect to the head of user 102 so that the techniques provided above for measuring hair thickness may be utilized to determine hair thickness both at the surface of user's 102 scalp and at various distances above user's 102 scalp. Hair collected at user's 102 scalp may be extended through cutter head 200 as hair cutting device 120 is extended away from user's 102 scalp and hair thickness may be measured substantially continuously so that hair thickness versus distance from user's 102 scalp may be measured and recorded.

As also described in Krenik '497, if cutter head 200 is extended away from a user's 102 scalp; hair 210 will be extended and slide through cutter head 200 until such a point that hair 210 slips out of cutter head 200, causing cutter knives 204 to actuate further to the left as hair 210 would no longer block their motion. Sensing when hair 210 slips out of cutter head 200 as the position and orientation of hair cutting device 120 is monitored allows the length of hair 210 to be measured. Repeated measurements of hair length at different locations on user's 102 scalp may allow a map of hair length versus location on a user's 102 scalp to be generated.

Figure 3:
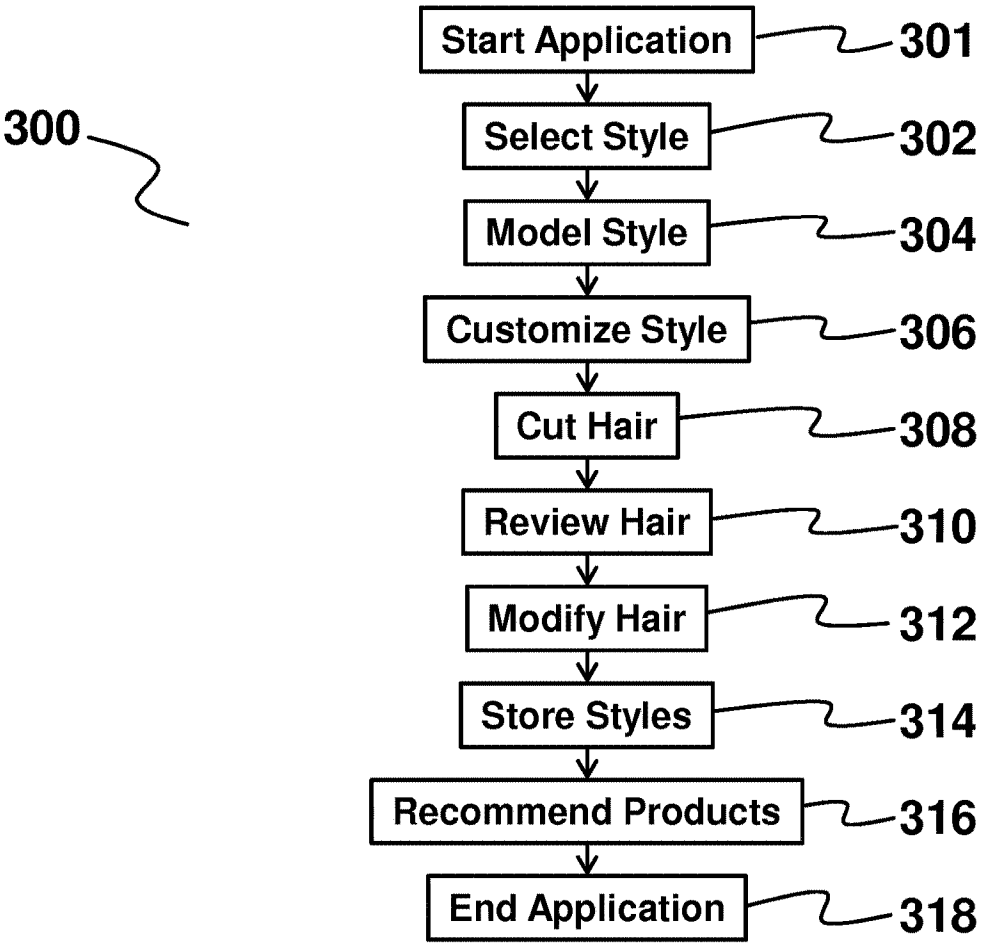
FIG. 3 is a flow chart that may be used for some embodiments of user interfaces for automated hair cutting systems.

Referring now to FIG. 3, there is shown a flow chart 300 that may be used for some embodiments of user interfaces for automated hair cutting system 100. User interfaces for automated hair cutting system 100 may be provided over a computer, cell phone, electronic tablet, specialized electronic computing devices constructed specially for automated hair cutting system 100, interfaces built into various elements of automated hair cutting system 100, such as electronic computing device 110, or other possible electronic systems that may be suitable for interfacing with user 102 of automated hair cutting system 100. Some embodiments of automated hair cutting system 100 may also, or alternatively include an electronic display on positioning device 104 and/or hair cutting device 120 and allow user 102 to interact with the system though buttons, controls, displays, and/or other interfaces also included on positioning device 104 and/or hair cutting device 120. Some embodiments of automated hair cutting system 100 may use electronic computing device 110 for more sophisticated interaction with user 102 such as hair style selection and hair style modifications.

In some embodiments, user 102 may select and customize their hair style using electronic computing device 110 alone without other elements of automated hair cutting system 100; and then cut their hair using only positioning device 104 and hair cutting device 120. Such an embodiment may make use of information on user's 102 hair thickness, hair length, and possibly other information previously stored in electronic computing device 110. For some embodiments, electronic computing device 110 may provide information on the hairstyle to be provided to user 102 to positioning device 104, hair cutting device 120, and/or other elements of automated hair cutting system 100 over a wired or wireless electronic interface so that the selected hair style may be provided without electronic computing device 110 nearby. Such an embodiment of automated hair cutting system 100 may allow user 102 to select and customize a hair style in a convenient and comfortable location and then move outside, to a bathroom, or to another area where cleanup may be easier, which may be convenient in situations where electronic computing device 110 is embodied as a desktop computer or other large device. Some embodiments of automated hair cutting system 100 may automatically detect the presence of electronic computing device 110 and alter the way they interact with user 102 depending on whether electronic computing device 110 is present or not.

Embodiments of the present disclosure relate a user interface for automated hair cutting systems for selection, modeling, modification, customization, and electronic use and storage of hair styles and information about a user such as their hair length, thickness, style preferences, and other information. A user may determine a hair style, and/or additionally provide information regarding a resulting hair style to a human hair stylist or hair cutting robot and ask that their hair be cut according to their selected style. For example, user 102 may utilize electronic computing device 110 to select, model, and customize a hair style and then take electronic computing device 110 with them (or transmit information from electronic computing device 110 regarding their style selection to another computer system or systems) to a human hair stylist to have their hair actually cut to the style as displayed on electronic computing device 110 (or another computer system). Accordingly, certain steps of flow chart 300 may be modified to account for embodiments in which hair is not actually cut using automated hair cutting system 100.

Flow chart 300 shows the process beginning at start application step 301 which indicates that a user interface may be initiated, which may include selection of an icon, or similar starting process on electronic computing devices. Start application step 301 may greet user 102 and may ask user 102 to set up a profile (if they are a first time user), to verify who they are (if they are a repeat user), or may allow user 102 an option to use automated hair cutting system 100 without providing information about themselves. A profile of user 102 may include information on their age, head size, head and scalp model, scalp maps of hair length, scalp maps of hair thickness, hair type, hair color, hair style preferences, date of their past haircuts and the style their hair was cut to, their address and contact information, credit card information, security keys, passwords, and other possible information about them.

Next, select style step 302 may present user 102 with a variety of hair styles that may be suitable for their hair. Styles may be presented to user 102 as visual images or videos as they would appear with user's 102 actual face (that is, based on an electronic image of user 102 modified to show user 102 with various hair styles), or may be shown with generic faces and heads, illustrated faces and heads, or in other suitable ways. Styles may be organized in groups such a men's styles, women's styles, children's styles, short styles for women, business haircuts for men, and other possible groupings. Some styles may be based on electronic information stored in electronic computing device 110 while others may be downloaded from the internet, internet servers, or other computers. Some styles may be available free of charge, while others may be offered for purchase. Some purchased styles may be utilized multiple times by a user, while the purchase price for others may provide a single use. Styles may be tailored to estimates of user's 102 hair length based on the time since their last haircut, and user 102 may be advised that some styles may not be possible given their estimated hair length.

Model style step 304 may involve use of hair modeling algorithms, infra, that provide a more detailed image of what an actual hair style might look like on a specific user 102. As described hereinabove user 102 may be directed to measure the length of their hair, select hair on various areas of their scalp so that hair thickness may be measured and mapped, wherein hair thickness and/or length may be used to model hair styles and to help assess what hair styles may be suitable or unsuitable for a given user. User 102 may also input, or pull up profile information from electronic computing device 110 about various details of their head, including locations of natural parts, bald spots, natural hair orientation, regions with coarse or bristly hair, hair stiffness, hair curliness, or other aspects of their hair that may be helpful in selecting a hair style.

Once a hair style has been selected and modeled, the style may be customized at customize style step 306. How the user interface may be used to customize the style will be discussed in more details in FIGS. 4-10D. The user 102 may be able to manipulate the length, thickness, height, direction of hair flow, tapering, thinning, and other aspects of a hair style to customize it to their preferences. Some hair styles available through the user interface of an automated hair cutting system may be fixed and user 102 may not be allowed to alter or customize them, while other hair styles may be customized to suit user's 102 preferences. Once a hair style is selected and customized, hair cutting may begin.

Cut hair step 308 may control the actual cutting, thinning, and styling of user's 102 hair and may follow information provided in Krenik '856 and/or other possible ways in which automated hair cutting system 100 may be applied. Cutting hair may involve the use of positioning device 104. In some cases, user 102 may be able to opt to have their hair cut to a somewhat longer length than is ultimately desired so that additional modifications may be incorporated. During hair cutting, user interface may provide user 102 with instructions and guidance on how best to manipulate their hair, what areas of their hair may best be cut first, what areas to cut later, and other useful advice. Automated hair cutting system 100 may keep track of any spots that user 102 might have missed in the course of a haircut and direct user 102 to come back to those spots later. Automated hair cutting system 100 may be designed to ensure that if positioning estimation errors or user errors occur, that hair is either not cut or cut slightly longer than its ideal length in areas where those errors occurred. Accordingly, if there are areas of user's 102 scalp where hair was not cut or was cut too long due to a possible error, user 102 may also be directed by the user interface to return to those areas and re-cut the affected hair to the correct length. In addition to cutting hair, cut hair step 308 may also direct user 102 through operations involving thinning or providing other styling effects to hair.

Once hair has been cut, the process proceeds to review hair step 310. Hair cutting results may be viewed by user 102 in a mirror or observed on a display of electronic computing device 110. Review hair step 310 may allow user 102 to view images or video of their hair, so they may note how their hair looks and if they like it. In some cases, user 102 may decide to make modifications to their hair style. Before user 102 begins to cut their hair (under control from cut hair step 308), they may be asked whether to cut their hair somewhat longer than their final desired style, such that modifications may be made if the initial result is not suitable or desirable to the user. How much longer hair is cut may be recommended by the system or selected by user 102, such as, for example, setting a percentage or certain measurement.

Once hair has been cut, review hair step 310 may allow user 102 to make modifications to their hair style as noted above. User 102 may note the flow of their hair and how it lies on their head and decide to thin some areas, cut hair shorter in other areas, and possibly change style effects in some areas. The user interface running on electronic computing device 110 may allow user 102 to make these modifications as will be shown in FIGS. 4-10D.

Once hair has been reviewed and the hairstyle changes have been completed, the user is able, if necessary, to further modify hair in modify hair step 312, wherein hair cutting, thinning, and/or styling operations may finish user's 102 haircut if necessary. If user 102 selected to cut their hair somewhat longer than their final goal on the first pass of hair cutting, the hair will be cut again to achieve the desired length. After hair cutting is complete, the user may again review their hair and make any additional modifications needed, for which the process would return to modify hair step 312.

Once hair has been cut and modified to an acceptable result, store styles step 314 may electronically store information about the final hair style that user 102 achieved. User 102 may also be allowed to store intermediate hair styles they might have worked with but decided not to undertake, intermediate stages they used before achieving a final style, and other hair styles they might want to have for future reference. Storing hair styles for future use may allow user 102 who only wants to trim their hair to regain a desired style, to do so very quickly as cut hair step 308 may then immediately cut hair to achieve the desired results. Hair styles stored may include an assigned style name selected by the user for future reference along with any other information a user may like to store for future use.

Some embodiments may measure and record hair thickness during cutting so hair thickness scalp maps may be updated and stored electronically on an ongoing basis. Some embodiments may also monitor and record hair thickness as a function of the distance that hair has been extended above user's 102 scalp. Store styles step 314 may also store the date and time that hair was cut and other information that some embodiments may allow users 102 to store for future reference. Information about when hair was last cut, the style it was cut to, hair thickness maps, and other information may be used in some embodiments to predict the length and condition of a user's hair at a later date so that use of an automated hair cutting system may take benefit of predictions of hair length and condition.

Once store styles step 314 is completed, products may be recommended at recommend products step 316. Recommend products step 316 may recommend products that user 102 may purchase. The recommendations may include product availability and nearby vendors where the products may be purchased, or products may be purchased directly through electronic computing device 110. Purchases made directly on electronic computing device 110 may utilize credit card or other payment information stored in electronic computing device 110 and may be shipped to an address for user 102 that is also stored in electronic computing device 110. Some products, such as cosmetics, hair accessories, jewelry, and other fashion accessories may be modeled with images of user 102 on the display of electronic computing device 110 so that user 102 may see how they might actually look with the product and with their freshly cut hair. The user interface may have information on many aspects of user 102 including their hair style, style preferences, hair color, skin color, age, sex, hair condition, how often they trim their hair, purchase history, the time of year, how fashion preferences change in the course of the seasons, information on trends in fashion and style, and other information that may be used to make recommendations to users for products that may appeal to them. Electronic computing device 110 may also deliver advertising information and may provide information and tips to user 102 on how best to use various styling tools and products.

Once recommend products step 316 is completed, end application step 318 may simply close operation of the user interface running on electronic computing device 110, but may also offer user 102 options regarding future use of automated hair cutting system 100. For example, end application step 318 may offer to send user 102 an email, text, or other reminder to trim their hair on a specific date or after a specific interval of time, and various other reminders which may be customized by a user.

Figure 4:
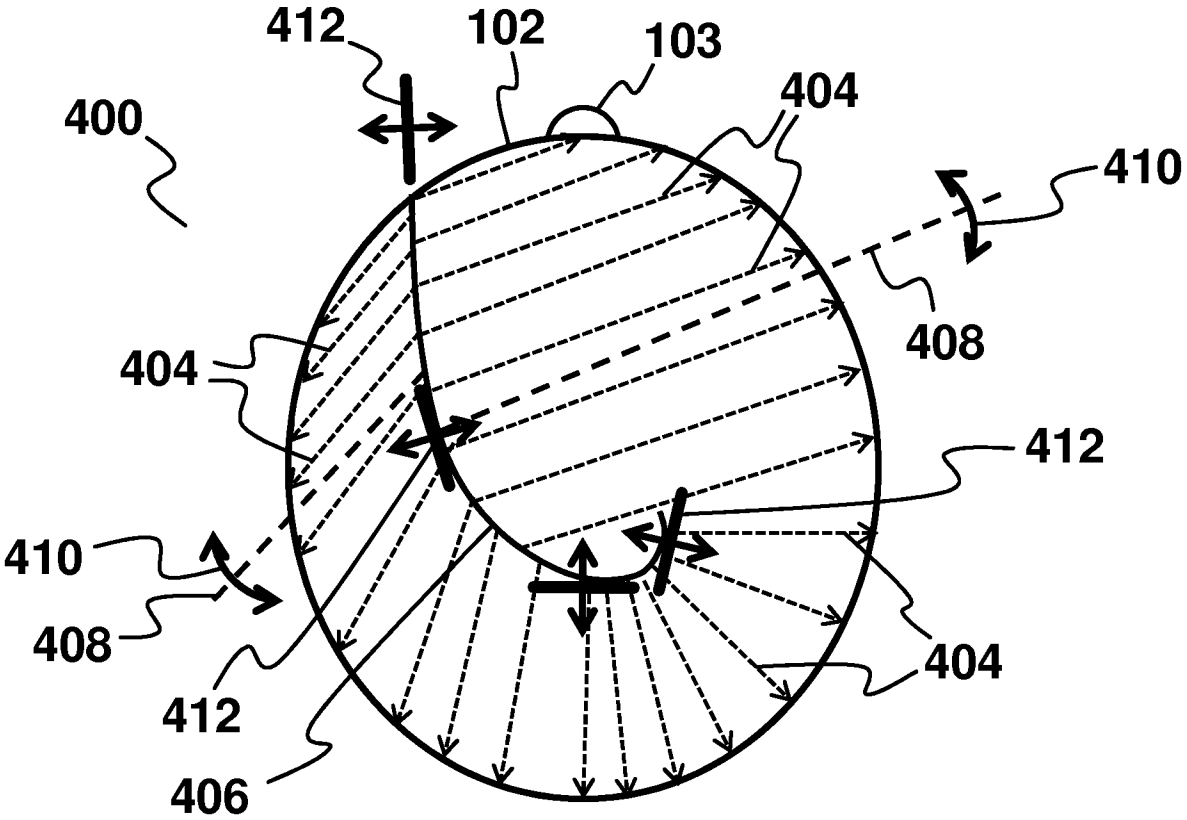
FIG. 4 is a top view of a user's head that may be shown in a display of an embodiment of a user interface according to the present disclosures and controls that may allow a user to interact with the user interface.

FIG. 4 shows a top view of a head map 400 of user 102 as may be presented in some embodiments of user interfaces for automated hair cutting systems. The head map 400 shown in FIG. 4 may correspond substantially precisely to a view from above the top of the head of user 102, but some embodiments may utilize head maps that may not correspond closely to the shape of a given user's head. A head map 400 that provides only a general resemblance to a user's head (such as a drawing, illustration, rough figure, or other resembling image) and provides sufficient controls and information so that a user may successfully interact with them may be sufficient for some embodiments. Hair part 406 and hair combing flow lines 404 show preferred directions in which hair may be combed for a hair style. FIG. 4 also shows various controls that may allow user 102 to interact with and possibly modify or customize a hair style using electronic computing device 110 or other possible interfaces. Rotation controls 410 allow user 102 to initiate rotation along dashed lines 408 around a fixed end where dashed lines 408 meet hair part 406 so that the direction in which to comb the hair may be changed. As user 102 rotates rotation controls 410, by moving them with finger touches on a touch screen display (or in other ways with other types of computer interfaces), the position of dashed lines 408 may rotate as will hair combing flow lines 404 in the vicinity of each dashed line 408 so that the direction to which hair is to be combed may be changed. Hair combing flow lines 404 may be controlled so that they rotate about fixed points along hair part 406 and hair combing flow lines 404 that are farther from dashed lines 408 may have their orientations interpolated between dashed lines 408 (or extrapolated beyond them) so that hair may be shown to be combed smoothly and naturally around user's 102 head.

Translation controls 412 are also shown in several locations on the head of user 102. User 102 may slide translation controls 412 laterally over the surface of a touch screen interface on electronic computing device 110 to move various features of a hair style laterally on the view shown. For the example of FIG. 4, the position and shape of hair part 406 may be moved on user's 102 head by sliding translation controls 412 in the view shown. Points between or beyond translation controls 412 on hair part 406 may be smoothly interpolated or extrapolated using a variety of well-known computer graphics algorithms or other possible algorithms.

Hair combing flow lines 404 as shown in FIG. 4 are shown as straight dashed lines, but may also be shown having curved contours. Accordingly, hair combing flow lines 404 may be shown as curved lines, arcs, or other suitable contours and user 102 may have options to alter both the shape and orientation of such curved lines, arcs, or other suitable contours. Embodiments of user interfaces may also enable user 102 to sketch the contours along which they intend to comb their hair via a touchscreen or other drawing interfaces.

Head map 400 as shown in FIG. 4 corresponds to a hair style including a side part 406 on the left side of user's 102 head. Other head maps may be utilized for other styles. Hair styles with center parts, parts on the right side, no parting of hair, and many other possible styles are possible. Head maps 400 may use lines and contours to indicate how hair is combed away from hair parts or other features in hair. Some embodiments of head maps may show small circles, points, or other features to show regions of hair styles in which hair is vertically "spiked" upwards from the scalp. Some head maps may even include multiple layers for styles in which hair is manipulated to be piled up vertically in multiple layers.

Figure 9A:
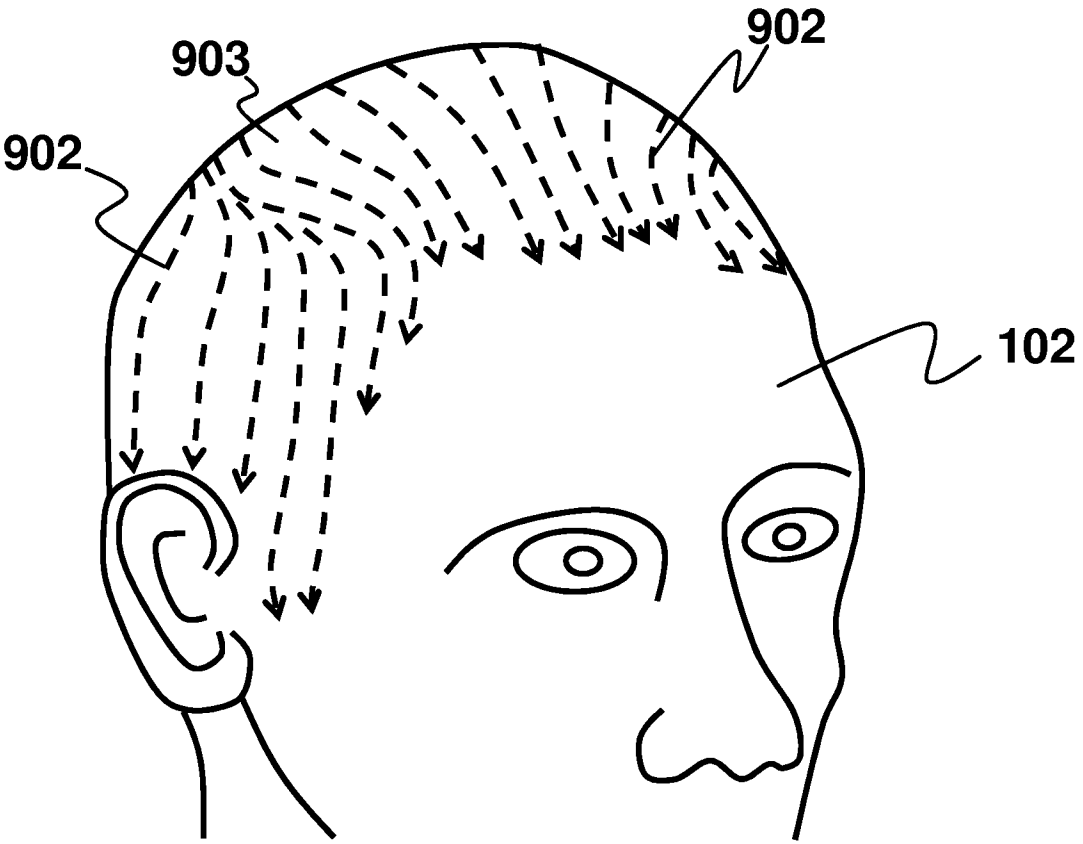
FIG. 9A is a perspective view of one embodiment of hair orientation flow lines shown on a user's head indicating the natural orientation of the user's hair.

Hair on most human heads naturally flows in certain directions. Hair follicles generate hair in preferred orientations in which hair on the top of the head generally flows toward the front of the head and hair on the sides and back of head generally flows downwards. For some styles, hair may be combed in the direction of its natural orientation, but for other styles and for some regions of a user's head, hair may be combed against or at angles to its natural orientation to achieve certain styling effects. For some embodiments of user interfaces for automated hair cutting system 100, a map of the orientation of hair over user's 102 head similar to the map shown in FIG. 4 may be used (for example, such a map is shown in FIG. 9A). The map may be presented on the user interface wherein user 102 may use rotation controls 410 and translation controls 412 at various places to accurately reflect the natural orientation of their hair. User 102 may determine the orientation of their hair at various locations on their head by feeling their hair and noting a preferred orientation at which it lays over smoothly and an opposite orientation at which it folds backwards and opposes motion. In some embodiments, user 102 may manipulate hair cutting device 120 over their head (with cutter head 200 idle) such that components, such as sensors on the cutter head, may determine hair orientation and provide signals to automated hair cutting system so that the orientation of hair at various locations on user's 102 head may be captured and modeled. A hair orientation map, a hair thickness map, a hair length map, and/or possibly other information may be used by hair modeling algorithms to determine, how hair may look when combed in certain directions (and the combing directions may be provided by head map 400 shown in FIG. 4). A hair thickness map may be determined using the method explained with regard to FIG. 2B, and a hair length map may be determined by measuring a user's hair length (as was also described with regard to FIG. 2B) or by using a hair length map associated with a hair style that user 102 may intend to cut their hair to. Accordingly, a user interface for automated hair cutting system 100 may model hair so that user 102 may observe what their hair may look like once it is cut and combed. In some embodiments, user's 102 hair may be modeled using its present length (before cutting), thickness (before thinning), and other factors as a check to demonstrate that the hair modeling algorithms being utilized produce acceptable results for user 102 before hair is actually modeled and cut to produce a new hair style. In some such embodiments, user 102 may be able to control the hair modeling algorithm to better model their hair before cutting.

While individual users 102 may have unique hair orientation maps, many users may have similar or conventional hair orientation and modeling of their hair may be sufficiently accurate if they simply select an orientation map presented by a user interface. Hence, some embodiments of user interfaces for automated hair cutting systems may offer users 102 a choice of one or more standard hair orientation maps that they may select for use in modeling their hair. Some embodiments may allow standard hair orientation maps to be customized by user 102 to better reflect the user's 102 hair orientation. FIG. 9A shows hair orientation flow lines 902 and further describes how hair orientation may be determined and modeled.

While FIG. 4 shows head map 400 providing a top view of the head of user 102, head maps showing views of the front, sides, back, and other views of the head of a user are also possible. Further, while the head map 400 shown in FIG. 4 is a two-dimensional view (2D view), some embodiments of user interfaces may provide three-dimensional views (3D views).

Figure 5:
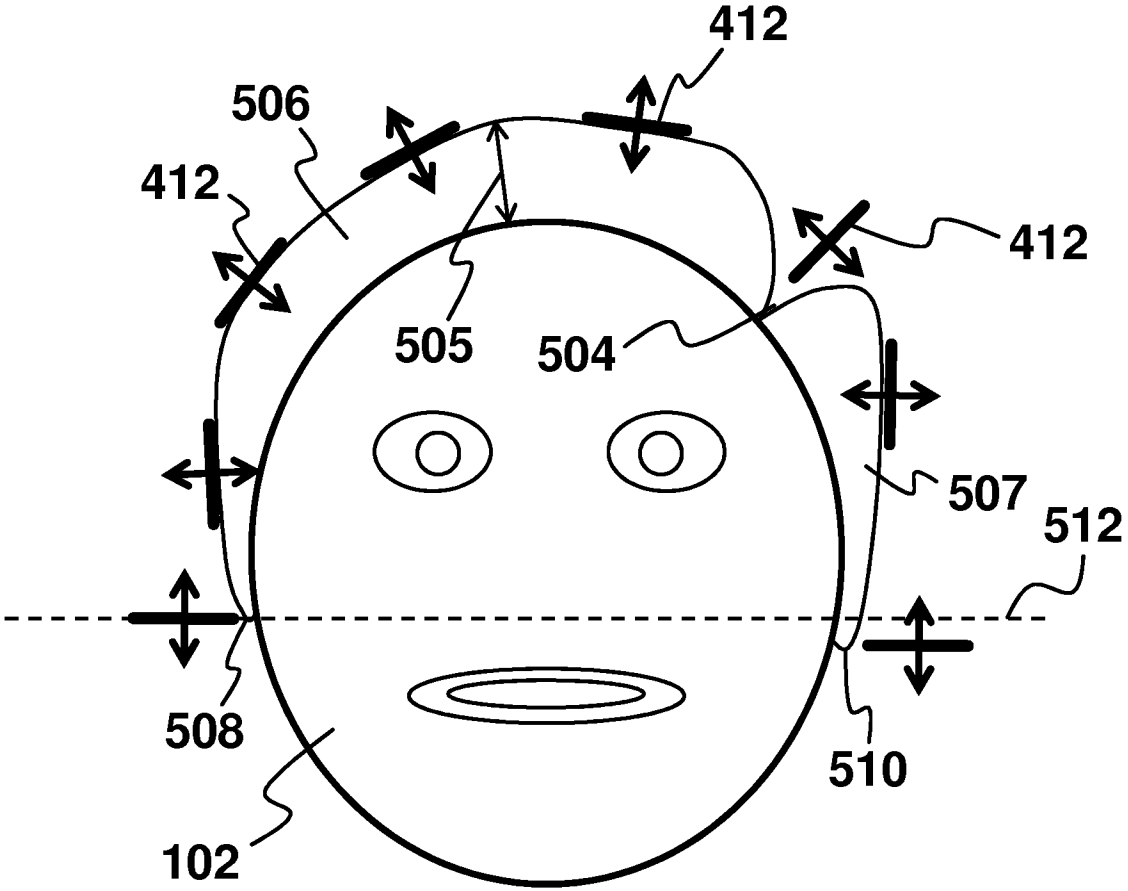
FIG. 5 shows a front view of a user's head as may be displayed in some embodiments of user interfaces for automated hair cutting systems and controls that may allow a user to interact with the user interface.

FIG. 5 shows a front view illustrating user's 102 head that may be presented in some embodiments of user interfaces for automated hair cutting systems. The view of FIG. 5 shows various translation controls 412 that may allow user 102 to vary the location of hair part 504, the hair height 505 of their right side hair 506 at various locations over their head, the height of their left side hair 507, the length of hair on their right side 508, and the length of hair on their left side 510. Dashed line 512 provides a horizontal reference line to allow user 102 to more easily manipulate the length of hair on their right side 508 and the length of hair on their left side 510 so that they may be made equal, or may be of different preferred lengths relative to each other. Hair height 505 in the present disclosure will refer consistently to how far hair extends substantially normal to and beyond user's 102 scalp, regardless of where the hair lies on the scalp. That is, hair height 505 on the side of user's head is a lateral measurement beyond the scalp. Hair height 505 on the top of a user's head is a vertical measurement beyond the scalp. Note that hair height 505 is used consistently with regard to a mass of hair (as is shown in FIG. 5 for hair height 505 of right side hair 506), while length of hair refers to the actual length of individual hairs extending from the scalp to their extended length.

The view of FIG. 5 may be taken at the front of user's 102 face or may be taken as a cross-section through user's 102 head at various locations. For example, a view similar to that of FIG. 5 may be taken just in front of user's 102 ears so that user 102 may interact with the view of FIG. 5 on electronic computing device 110 and adjust various aspects of their haircut over their head and in the vicinity of their ears. A large variety of views similar to the view of FIG. 5 may be utilized to allow user 102 to interact with the user interface and adjust various aspects of a hair style. Front views, back views, cross-sectional views taken parallel to a front view, side views from the right, side views from the left, cross-sectional views taken parallel to side views, and other possible views may be utilized to allow a hair style to be adjusted and customized. Regions of user's 102 head that are not directly viewed and adjusted by user 102 though these views may be modeled using computer interpolation and/or extrapolation techniques so that substantially all regions of user's 102 hair may be modeled and observed.

While user 102 may interact with an image, drawing, or likeness of themselves such as the view of FIG. 5 and adjust various aspects of their hair style, it may not be possible to actually produce the selected hair. Factors such as hair thickness, length, curliness, head shape, and various other factors may prevent the user from achieving the selected hair style. Information about the length, thickness, nature, and possibly other factors of a user's hair stored on a processor of user interface, may be considered when providing information to the user through the display. For example, in FIG. 5, the hair height 505 of right side hair 506 on user's 102 head may be adjusted with translation controls 412. In the case that a translation control 412 is moved up so far that it is no longer possible to achieve the requested level of hair height 505, the user interface may signal an error or warning to the user 102 so that they realize that their desired style may not be realistically achieved. Such an error or warning may include an audible signal (a beep, chime, buzzer, etc.) and/or a visual indication such as the outline of user's 102 right side hair 506 turning red (or another color), blinking, or otherwise providing a visual indication that the user 102 has requested a result that may not be possible to achieve. Some embodiments of user interfaces may not allow user 102 to make adjustments to a hair style that are not possible for their hair type. In some embodiments, users 102 may have an option to ignore, delete, or silence an error message and move on with their hair cut. In some embodiments, users 102 may have an option to enter additional information about their hair (such as measuring their actual hair length, thickness, etc.) into user interface so that the hair modeling algorithm being used may determine that the hair style customizations they have made are, in fact, possible to achieve.

How hair is modeled by an algorithm to produce illustrations or images, such as the view of FIG. 5, in response to information available about user's 102 hair depends on many factors. The thickness, natural hair orientation, stiffness, length, combing direction, and other factors may affect how high (i.e. hair height 505) the right side hair 506 of user 102 may actually be. Even other factors such as the weather (temperature and humidity of the air), whether or not user 102 regularly wears a hat, the type of hair care products user 102 uses, and other factors may impact how high the right side hair 506 of user 102 may actually be. Automated hair cutting system 100 need only cut hair to user's 102 requests, and cannot guarantee perfect hair in all conditions. Hence, if automated hair cutting system 100 is directed to reduce the hair height 505 of right side hair 506, it may determine to thin right side hair 506 somewhat so that the hair height 505 it lays above user's 102 scalp is reduced. Automated hair cutting system 100 may utilize algorithms that estimate how high hair will lie in a given region of user's 102 head depending on the orientation at which it emerges from the scalp, how thick it is, how much hair from neighboring regions of a user's scalp overlay it, how it is combed, how curly the hair is (this may be input by a user and may be rough guide such as "straight, somewhat curly, or very curly), the mass of hair in the region (simply the total amount of hair material that is present, using hair mass as an indicator may be especially helpful for hair styles that have an intentionally random or messy look), the amount of hair hanging over user's 102 head that adds weight and "pulls" on a given region of hair, and other factors.

While hair modeling algorithms may provide estimates of how hair will look after it is styled, these estimates may sometimes not provide highly precise results. However, in experimenting with their hair, users 102 may interact with the user interface to improve results over multiple attempts. As discussed in conjunction with FIG. 3, hair may be initially cut a bit longer than desired so that a better idea of final results may be predicted before hair is fully cut to a final length. Some embodiments of user interfaces may allow user 102 to model how their hair would look if combed and/or styled a certain way while at its present length (that is before it is cut), so that the user may comb and/or style it that way and compare the result of hair modeling algorithms with how they actually look. Accordingly, user 102 may be allowed to adjust some aspects of a hair modeling algorithm to tune the algorithm to provide suitable modeling results for their hair. If user 102 interacting with the image of themselves shown in FIG. 5 realizes that their actual right side hair 506 is turning out much higher (that is, hair height 505) on their scalp than they want it to be, it is an easy thing to adjust the image of FIG. 5 using translation controls 412 to thin their hair so that they achieve a more desirable final result. Hence, high precision of hair modeling hair may not be necessary and a relative view of how hair will look that provides intuitive and simple ways to make adjustments may allow user 102 to reach acceptable results and to repeat those results on an ongoing basis.

The view of FIG. 5 anticipates that user 102 will observe an image of themselves and make adjustments to the view to improve overall results and as such, the processor may use inputs and adjustments made by the user into the user interface when preparing the hair cutting algorithm. While a simple algorithm is described in the present disclosure, many hair modeling algorithms are possible. For example, some algorithms may assume hair is long enough to meet the requirements of a style specified by a view such as that shown in FIG. 5 and it may use only a single measurement of hair thickness and assume uniformly thick hair covering user's 102 scalp. A head map 400 may be utilized so the hair modeling algorithm knows how hair will be combed. The algorithm may assume straight hair only (at least at first) and may generate a hair length map for hair cutting to achieve a desired style. Taking right side hair 506 as an example, hair on the lower side of user's 102 head may be cut to meet the requirement of length of hair on their right side 508 and hair further up the side of user's 102 head may be cut a bit longer to reach the same length of hair on their right side 508 until hair reaching length of hair on their right side 508 becomes too "high" (again, here "hair height" is a measure of how high hair extends above the scalp regardless of the scalp orientation, this is consistent with hair height 505 as shown in FIG. 5, so the height of hair at length of hair on their right side 508 is actually a horizontal measurement of how far the right side hair 506 extends to the user's 102 right beyond their scalp). As the simple algorithm progresses up the side of user's 102 head, it begins to shorten the length to which hair will be cut to meet the "height" requirement of hair above user's scalp as defined by the profile for right side hair 506 as shown in FIG. 5. This is continued until hair part 504 is reached.

More complex hair modeling algorithms may go beyond the simple algorithm described in the paragraph above (which, essentially, only summed up how hair would "stack up" as layers of hair lay on top of others so that the height of a pile of hair is controlled). For the algorithm described above, persons with very thick hair might end up with a short, bristly cut while persons with very thin hair may not meet the profile for right side hair 506 shown in FIG. 5. A simple restriction of the algorithm to ensure that hair at the top of the user's 102 head be cut at least long enough to extend halfway from the top center of the user's 102 head to their length of hair on their right side 508, would ensure sufficiently long hair so that thick hair would not be cut too short and result in a bristly result (this restriction is only an example, other restrictions on minimum hair length may be applied in other embodiments). With this restriction, height 505 may be exceeded. For that situation, right side hair may be selectively thinned so that both hair height 505 over the full extent of right side hair 506 is met while overall hair length is kept sufficiently long for a smoothly flowing result. Other factors may be taken into account if hair is curly. Curly hair may be twice the height of straight hair and very curly hair may be three times the height of straight hair (other factors may be applied and these may even be selectable by user 102). Additional factors may be applied for hair that is very thin, very stiff, very limp, or has other attributes that may affect how it flows in a hair style.

In some cases, user 102 may simply know how they want their hair cut. A simple men's haircut, for example, may simply cut all the hair on user's 102 head to substantially the same length and then taper the sides to the scalp line. Hence, a very simple directive to "cut hair 2 inches long and taper the sides and back" may be all that is needed for automated hair cutting system 100 to fit such a simple style to user's 102 head. Since previous measurements of the user's 102 head shape and scalp lines provide the basic boundaries over which the style is to be fit, the only factor to determine may be where to begin tapering the sides and back (and that may be easily determined as a given level above the scalp line, a given percentage of the distance over the user's head, or other simple factor; or the user may simply be asked to input it using a view such as the one shown in FIG. 5). More complex directives from users such as where to thin hair, how to layer hair, how to style hair around the ears, how to style the neck line, and other elements of a hair style may be input or may be selected from views of multiple options provided through a user interface associated with or incorporated with electronic computing device 110 or other suitable user interface.

Figure 6B:
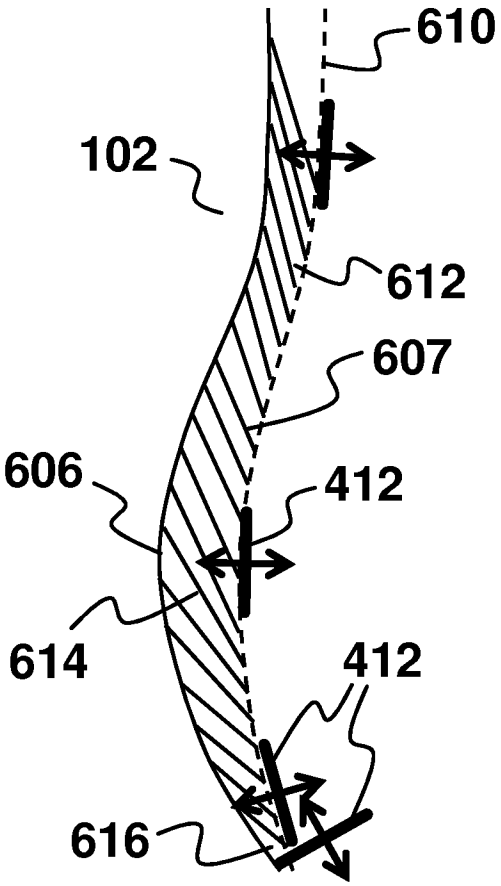
FIG. 6B is a side view of the back of a user's head and neck, as may be presented in some embodiments of user interfaces for automated hair cutting systems.
Figure 6A:
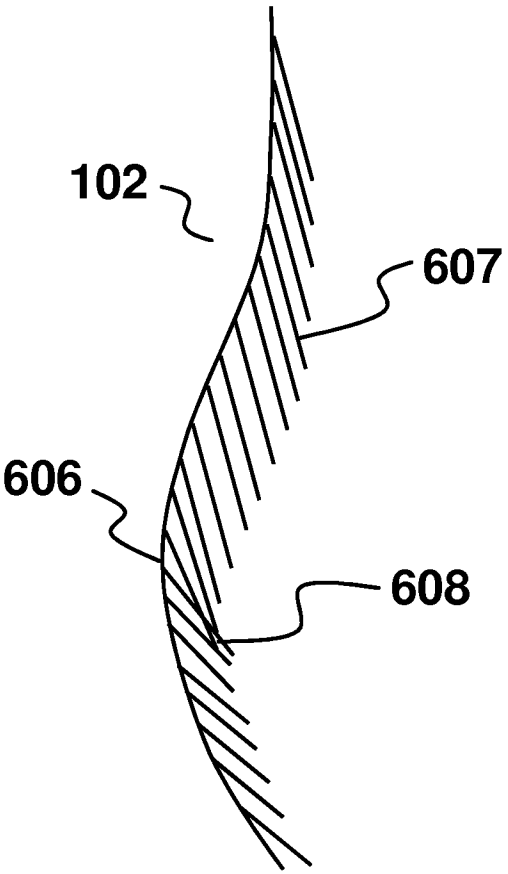
FIG. 6A is a side view of the back of a user's head and neck, and shows how hair may bulge at the nape of the user's neck if hair is cut to substantially uniform length.

FIG. 6A shows a side view of the back of user's 102 head. User 102 has hair 607 emerging from their scalp and extending outward to the right. Nape 606 of user's 102 neck is shown. Hair 607 is shown in FIG. 6A to be at a substantially uniform length and hair cut in such a manner may result in a bulge 608 of hair in the nape 606 of user's 102 neck. The bulge results from the concave nature of the nape 606 of user's 102 neck and such a bulge may be undesirable at least for some users (and for some users 102, multiple bulges may result). The bulge 608, while shown as relatively small in size in FIG. 6A, may be larger on a user with thick hair.

FIG. 6B shows another side view of the back of user's 102 head including nape 606 of the user's 102 neck and hair 607. The view of FIG. 6B may be presented in some embodiments of user interfaces for automated hair cutting systems. In the view of FIG. 6B, translation controls 412 have been used to adjust a hair length profile 610 shown as a dashed line so that upper hair 612 above nape 606 is cut somewhat shorter and lower hair 616 below nape 606 is tapered to the lower edge of the scalp. Nape hair 614 in the nape 606 of user 102 is shown to flow smoothly and bulges at the nape 606 of the neck of user 102 have been avoided. FIG. 6B shows an example of how a user interface may be utilized to overcome a styling challenge and produce a more desirable result. User 102 may be prompted if bulging at the nape 606 of their neck is an issue and the system may offer advice and options for how it may be corrected.

Figure 7B:
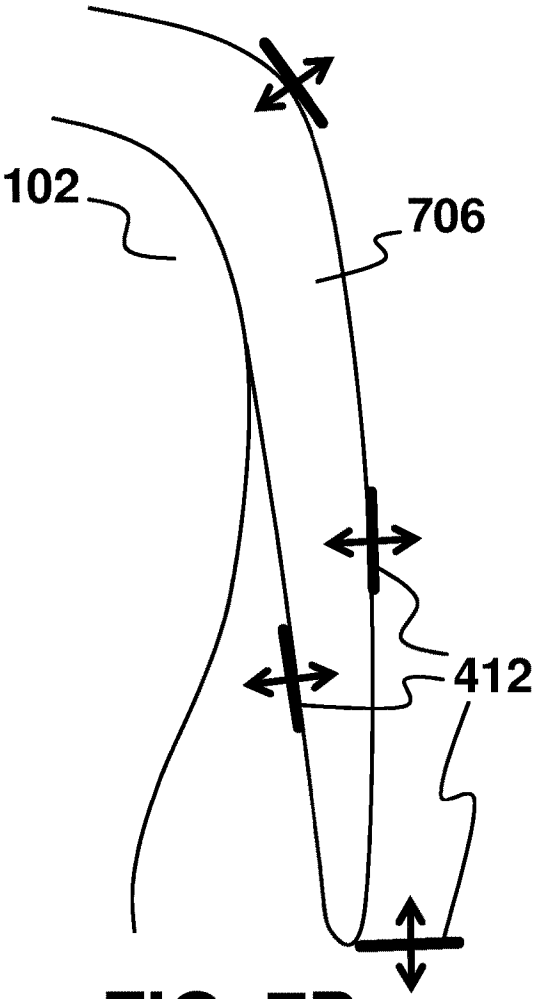
FIG. 7B is a view of the back or side of a user's head as may be presented in some embodiments of user interfaces for automated hair cutting systems.
Figure 7A:
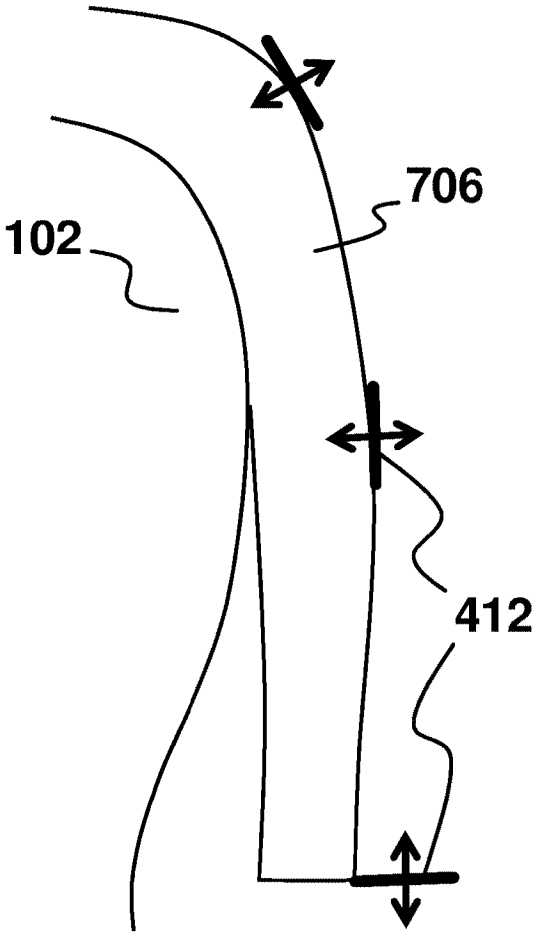
FIG. 7A is a view of the back or side of a user's head as may be presented in some embodiments of user interfaces for automated hair cutting systems.

FIG. 7A shows the side or back of the head of user 102 and how the thickness and length of hair 706 may be adjusted with translational controls 412. User 102 in FIG. 7A is shown with long hair flowing over their scalp and down the side or back of their head. User 102 operating the user interface need only slide translational controls 412 to adjust their hair length and style. FIG. 7A shows a style in which the end of hair 706 is square cut. In FIG. 7B, the same user 102 with hair 706 is shown, but hair 706 is tapered at the end. Tapering may be achieved in automated hair cutting system 100 by how hair is layered and thinned as it flows over the side of user's 102 head. The thickness of the taper may be adjusted with the user interface by sliding translational controls 412 to desired locations.

Figure 8:
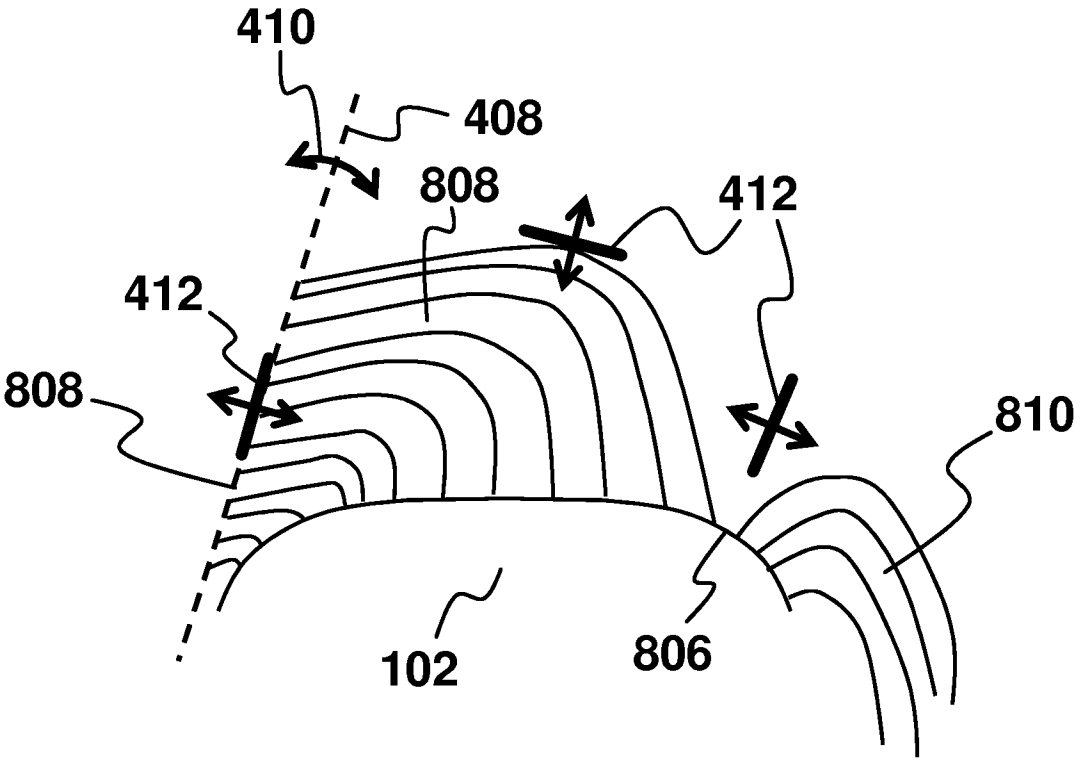
FIG. 8 is a view of the front of a user's head as may be presented in some embodiments of user interfaces for automated hair cutting systems.

FIG. 8 shows a view of the front of user's 102 head on a user interface in which a hairstyle has been chosen that requires hair to be piled up on top of user's 102 head and includes an abrupt profile 808 along the right side of user's 102 head. The location of part 806 may be adjusted with a translational control 412 as may be the height of right side hair 808. Left side hair 810 is shown and some aspects of it may also be adjusted, but the adjustment controls are not shown in FIG. 8 to avoid cluttering the figure. The location of abrupt profile 808 may be adjusted with a translational control 412 and the angle of abrupt profile 808 may be adjusted with rotational control 410. Abrupt profile is shown along dashed line 408 for reference. FIG. 8 provides yet another example of how user interface and associated images and controls may be used to adjust and customize hair styles.

FIG. 9A shows a perspective view of the head of user 102 as may appear in some embodiments of user interfaces for automated hair cutting system 100. Hair orientation flow lines 902, shown on user 102 in FIG. 9A, provide an embodiment of orientation flow lines 902 on a three-dimensional model of user's 102 head. As explained previously with regard to FIG. 4, hair orientation is taken in the present disclosure as the favored direction that hair emerges from scalp 903. As shown in FIG. 9A, user 102 sliding their hand over the top of their head in the direction hair orientation flow lines 902 are pointing would feel a smooth flow of hair; while user 102 sliding their hand opposite the direction of hair orientation flow lines 902 may feel a rough, bulging, or inhibiting effect from the hair below their hand.

Hair orientation flow lines 902 will generally flow in different patterns for different users. User 102 having very short hair may be able to establish the pattern and direction of orientation flow lines 902 for their head by taking camera images or video of their head and allowing computer vision algorithms to determine hair orientation flow lines 902. Computer algorithms may also be able to determine hair orientation flow lines 902 from camera images taken along parts in user's 102 hair. In some embodiments, a user may input their hair orientation directly into the user interface or electronic computing device 110 using a touch screen display or other input interface tools to indicate hair orientation over their scalp 903. Some embodiments of hair cutting devices 120 may be used to detect hair orientation by sliding the tips of cutter head 200 along the surface of scalp 903 while user 102 feels the effect of the sliding tips of cutter head 200 on their hair. User 102 may then indicate the orientation of their hair on various regions of their scalp 903 by sliding cutter head 200 along their scalp 903 so that automated hair cutting system 100 may use knowledge of the location of cutter head 200 on user's scalp 903 and the direction it is being moved to map out hair orientation flow lines 902. Some embodiments of hair cutting devices 120 may include components including a plastic comb or other attachments that affix to cutter head 200 that are configured to determine hair orientation. For example, a "snap on comb" may have long and delicate comb teeth that allow user 102 manipulating hair cutting device 120 to easily determine the orientation of their hair over the extent of their scalp. Use of a hair cutting device 120 to determine orientation of hair may benefit if user 102 manipulates hair cutting device 120 themselves as they can feel both the motion of hair cutting device 120 and the sensation of their hair and scalp.

While different users 102 may have different hair orientation flow line 902 patterns, many users 102 may have similar hair orientation patterns and some embodiments of user interfaces may offer users 102 a variety of orientation patterns that they may use as a suitable model for their hair or may use as a starting point for customization and editing to provide a more accurate model of their hair orientation pattern. Some embodiments of user interfaces may also allow user's 102 to input general information about themselves that allow the user interface to make certain assumptions or default conditions for their hair. For example, if someone were to select their hair type as "Scandinavian Blond", the user interface may be able to make some assumptions about the user's hair orientation pattern, hair thickness, hair stiffness, how curly their hair is, and other assumptions. These assumptions or default hair modeling parameters may be edited or customized by user 102. The use of such general or common hair types may be convenient for some users working with some embodiments of user interfaces. Common hair types offered to users as a starting point for hair modeling may include such hair types as Scandinavian blond hair, Afro (African) hair, curly dark hair, fine red hair, limp blond hair, black Asian hair, Irish red hair, strawberry blond hair, and many other common hair types.

Figure 9B:
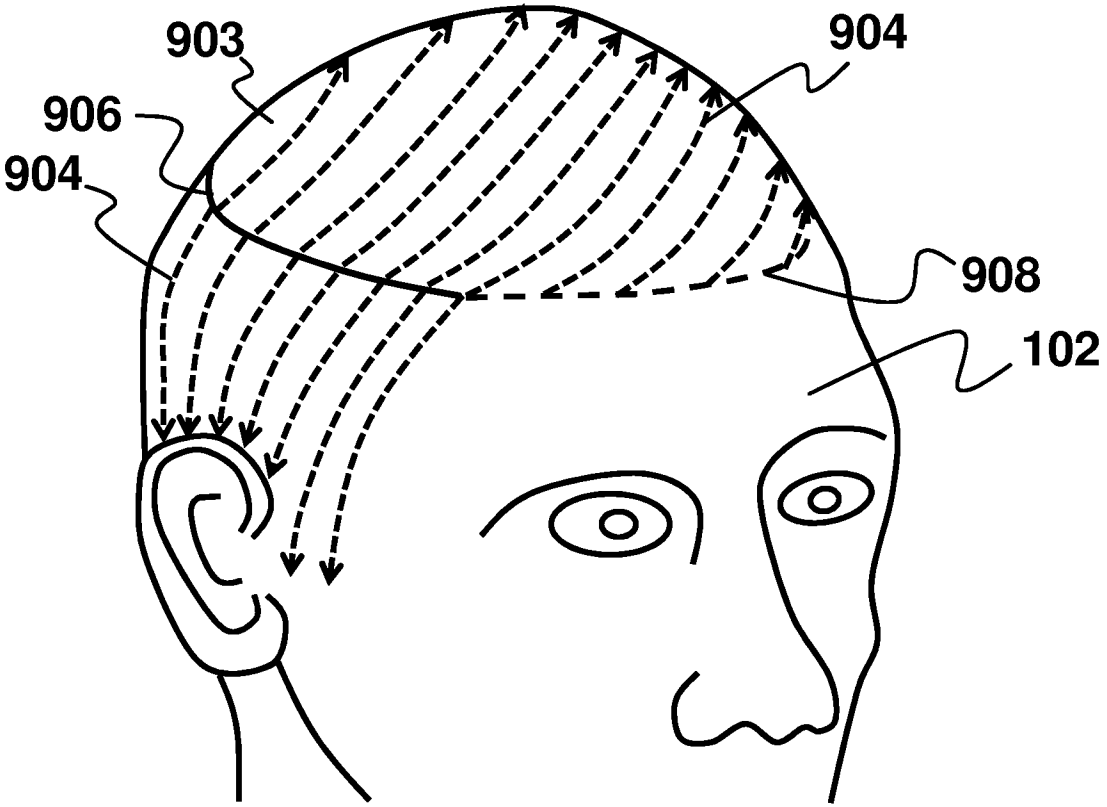
FIG. 9B is a perspective view of an embodiment of hair combing flow lines shown on a user's head indicating the way the user intends to comb their hair.

FIG. 9B shows a perspective view of the user 102 from FIG. 9A, but with hair orientation flow lines 902 replaced with hair combing flow lines 904. The embodiment of FIG. 9B may also be presented to user 102 on electronic computing device 110 or other user interface. Hair combing flow lines 904 cover scalp 903 and indicate the directions that user 102 prefers to comb their hair. Hair combing flow lines 904 in FIG. 9B have the same function as hair combing flow lines 404 shown in FIG. 4. Hair combing flow lines 904 have been numbered differently in FIG. 9B and FIG. 9C versus those in FIG. 4 as they are shown on a three-dimensional head model and are not flat and straight, but both hair combing flow lines 904 and hair combing flow lines 404 serve to indicate the pattern and direction in which hair is to be combed. User's 102 hair includes hair part 906 along the upper right side of user's 102 head (some other embodiments may show user 102 with a hair part on their left side, and some embodiments may show very different hair styles on user 102, this variety of hair styles and features is provided to help demonstrate the breadth of possible hair style options and should not create confusion). Scalp edge 908 is shown as a dashed line in FIG. 9B to indicate the extent of scalp 903 along the top of user's 102 forehead. Hair combing flow lines 904 may be determined by computer algorithms applied to camera images or video of user's 102 combed hair; or by user 102 manipulating hair cutting device 120 so that automated hair cutting system 100 may determine the direction hair is to be combed; or through interaction with an image shown on a display of a user interface such as the image shown in FIG. 9B, or by using a touchscreen or other input interface to directly input an intended hair combing pattern.

Figure 9C:
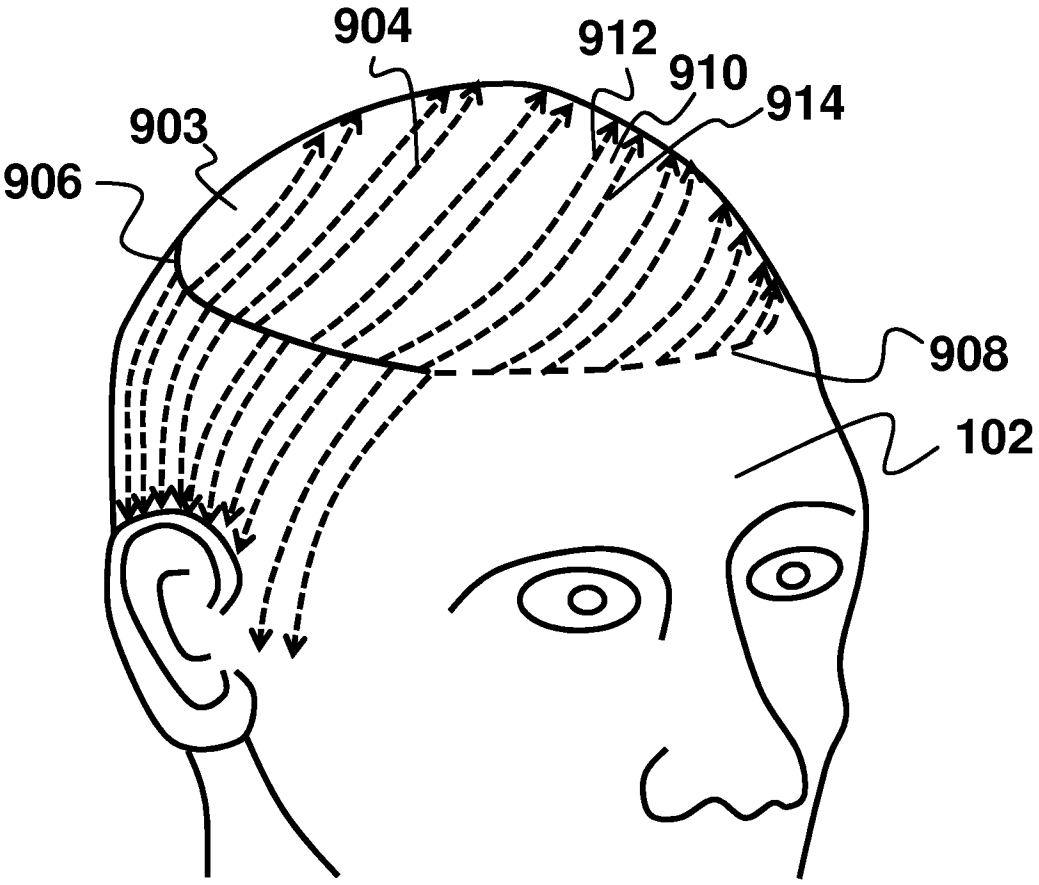
FIG. 9C is a perspective view of another embodiment of hair combing flow lines shown on a user's head including indicating the way the user intends to comb their hair.

FIG. 9C shows the user 102 previously shown in FIGS. 9A-9B. Numbered elements of FIG. 9C are the same as so numbered elements in FIGS. 9A-9B. In FIG. 9C, hair combing flow lines 904 have been arranged in pairs of lines that are substantially uniformly separated as they progress over scalp 903. Hair combing flow lines 904 arranged in pairs may allow some embodiments to apply simpler computer algorithms for modeling hair. How hair may be modeled will be described with regard to subsequent figures. In FIG. 9C, first hair combing flow line 912 and second hair combing flow line 914 define a hair modeling channel 910 between them. A hair modeling algorithm may model hair in hair modeling channel 910 to provide estimates of hair height 505 and other possible aspects of hair in hair modeling channel 910. Some hair modeling algorithms may define how hair may be cut to various lengths, thinned, or otherwise styled along hair modeling channel 910 to provide a desired hair style to user 102. If hair is modeled, and/or if a model for how hair may be cut along a hair modeling channel 910 is determined for the various hair modeling channels shown, then interpolation and/or extrapolation algorithms may be utilized to determine hair height 505, other hair modeling parameters, lengths to which hair may be cut, how hair may be thinned, or how hair may be otherwise styled between the hair modeling channels shown in FIG. 9C.

Hair modeling channel 910 begins at hair part 906 and progresses over the top of user's 102 head. Hair modeling channel 910 will be assumed to progress over the side of user's 102 head not visible in FIG. 9C to the edge of user's 102 scalp near their left ear. Hair modeling channels may be defined for a wide range of hair styles and may normally begin and end at hair parts, features in hair, along edges of the scalp, along edges of bald spots, and possibly at other locations on or around user's 102 head (note that many hairstyles involve hair extending beyond the scalp, so hair combing flow lines and hair modeling channels may extend beyond user's 102 scalp). Hair modeling channels begin may be defined automatically based on a basic style selected by user 102 utilizing a user interface for an automated hair cutting system, may be defined by user 102 through interaction with a user interface, or may be defined in other possible ways. While use of hair modeling channels with substantially uniform width such as hair modeling channel 910 may be convenient for some embodiments of modeling algorithms, hair modeling channels may also be defined and modeled or analyzed based on the hair combing flow lines 904 shown in FIG. 9B, or possibly other embodiments of hair combing flow lines. While the present disclosure provides embodiments that model hair along hair modeling channels established by hair combing flow lines, hair modeling algorithms may be applied instead along hair orientation flow lines, other flow lines, grid patterns formed on scalp 903, or in other possible ways.

Figure 9D:
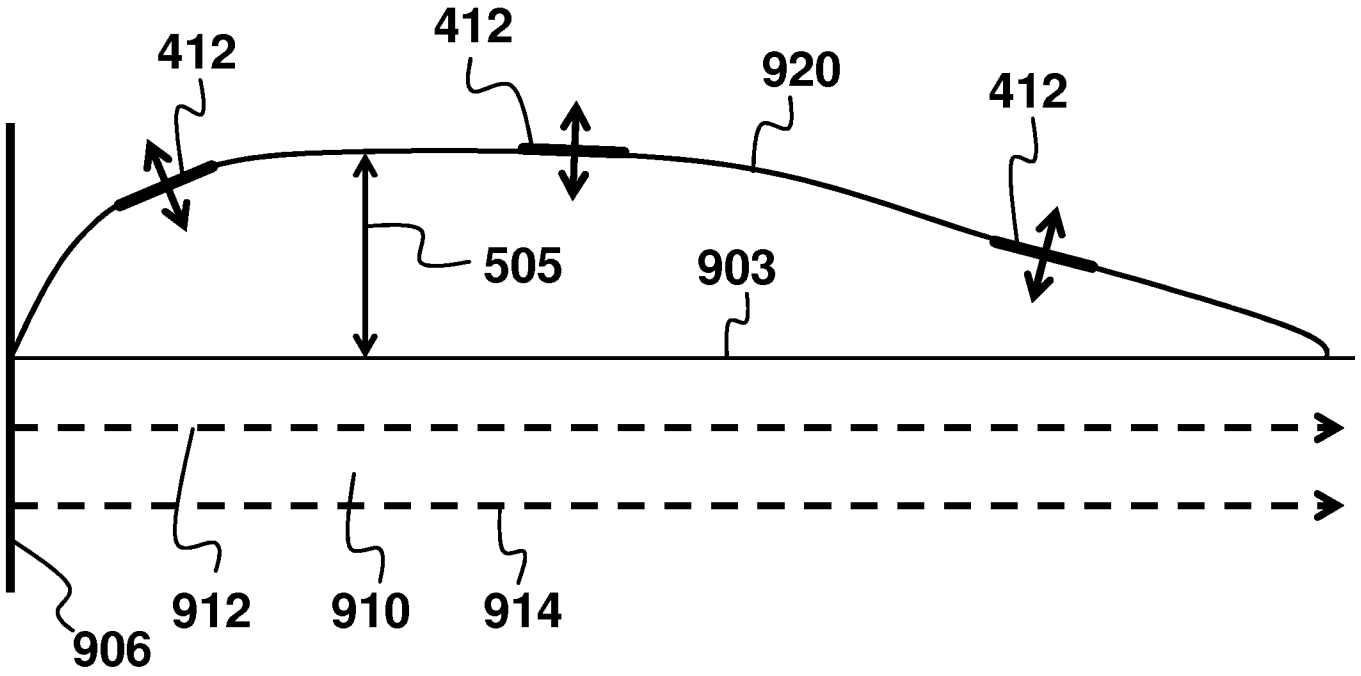
FIG. 9D is a view of a hair height profile taken across the head of the user shown in FIGS. 9A-9C along with a view of flow lines defining a modeling channel in which hair height is modeled.

FIG. 9D shows a schematic view of hair modeling channel 910, shown in FIG. 9C and defined by first hair combing flow line 912 and second hair combing flow line 914, where the hair combing flow lines are shown as straight lines beginning at hair part 906 and extending to the right. The view of FIG. 9D may be presented in some embodiments of user interfaces and provides a convenient way for hair modeling channel 910 to be viewed so that hair modeling algorithms, hair modeling parameters, and other aspects of hair modeling may be more easily explained. Hair part 906 as shown in FIG. 9D is a reference to hair part 906 as shown in FIGS. 9B-9C. FIG. 9D also shows hair profile 920 that provides hair height 505 above scalp 903 along the length of hair modeling channel 910. Translation controls 412, or other suitable controls, may allow user 102 to manipulate their desired hair height 505 along the extent of hair modeling channel 910 if an image similar to that of FIG. 9D is provided on electronic computing device 110 or other display or user interface.

Many algorithms may be applied to model hair and aspects thereof including its height, thickness, texture, and other aspects. While all possible hair modeling algorithms cannot be explained in the present disclosure, some aspects may be demonstrated for possible embodiments. For the purpose of illustration of one possible embodiment, the description of hair modeling with regard to FIGS. 9D-10D will be based on the hair height equation:

Hair height=thickness*pile*orientation factor*pull factor*curl

In the hair height equation, hair height refers to hair height 505 as shown in FIG. 9D (and in FIG. 5 and several other figures) and represents the height of a mass of hairs that may lay on or around user's 102 head. Hair height 505 varies along hair modeling channel 910 as shown with hair profile 920. Thickness is a measure of how thick hair is on user's 102 head and may be measured as explained with regard to FIG. 2B. Hair thickness may be expressed as a percentage of a region of user's 102 scalp actually covered by solid hair mass, or by other convenient measures for various embodiments. The embodiment of FIG. 9D assumes that hair thickness is substantially consistent over the length of hair. However, some embodiments may model hair thickness also as a function of distance above user's 102 scalp. Pile is explained with regard to FIG. 9E and relates to how hair may pile up as hair is combed over other hair below it. Orientation factor is explained with regard to FIG. 9F. Pull factor is explained with regard to FIG. 9G. Curl is a measure of how curly hair is and may be a simple factor that user 102 inputs into electronic computing device 110 in some embodiments. In some embodiments, curl may simply be an indication of straight hair (curl=1), slightly curly hair (curl=2), moderately curly hair (curl=3), or very curly hair (curl=4). The hair height equation above is provided as an example of a possible embodiment and many equations with similar or other terms may be used. Constants of proportionality or weighting factors may be applied to some or all of the factors, the factors may be defined differently, additional factors may be applied, some terms may be added or summed instead of being multiplied together, some terms may involve integration or differentiation, some embodiments may utilize recursive algorithms or numerical methods, or other mathematical terms, operations, or other techniques that may be utilized for various embodiments.

As noted previously, some embodiments of user interfaces may allow user's 102 to input common hair types and these or other hair modeling parameters may have impact on how the hair height equation is formulated. For example, user 102 who inputs that they have African (Afro) hair, may signal to user interface to utilize certain modeling parameters for their hair and to possibly also modify the hair height equation shown above for their use to more accurately model their hair. Other factors such as whether hair styling products such as hair creams, gels, straighteners, stiffeners, or other styling products are to be utilized and accounted for in hair modeling, the nature and effect of those styling products, whether or not hair will be blow dried, whether or not hair will be curled with a curling iron or other curling techniques, and other possible factors may be incorporated into hair height and other hair modeling equations and/or algorithms for some embodiments.

Figure 9E:
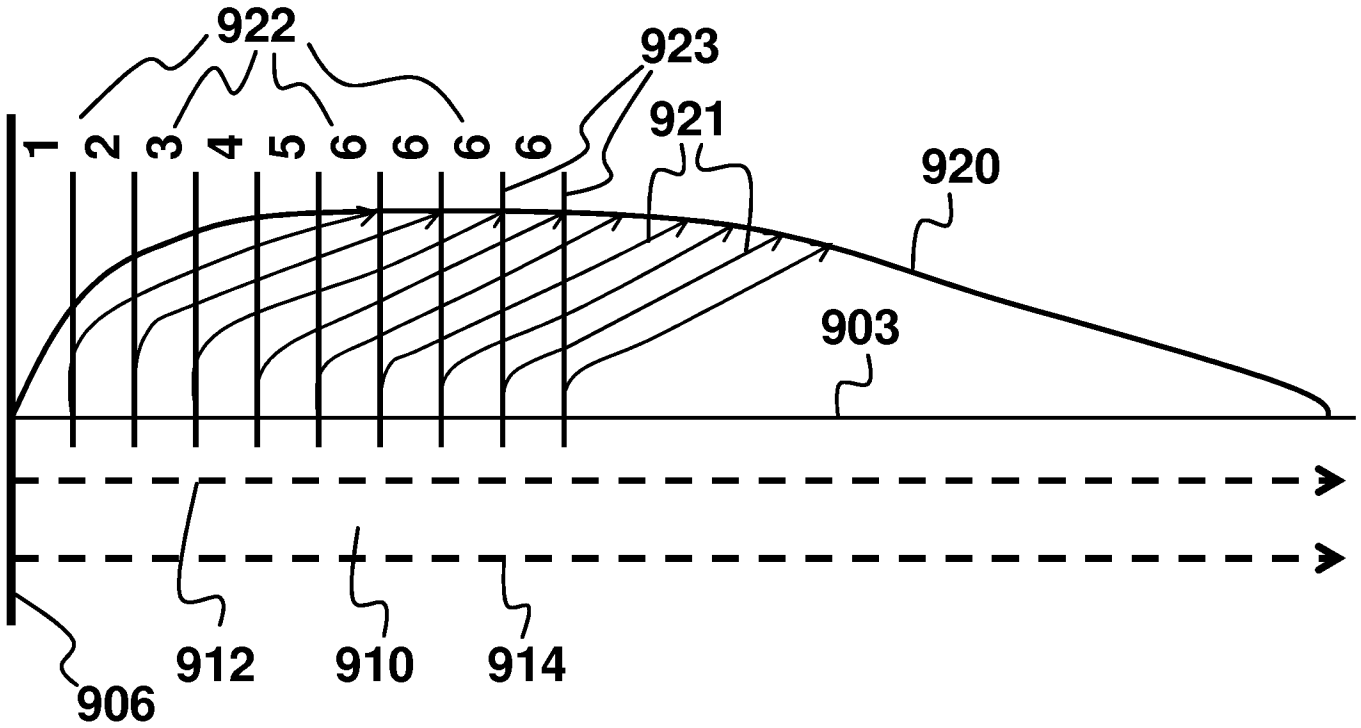
FIG. 9E is a view of a hair modeling channel broken into intervals and with flow lines indicating how hair may pile up as it is combed over adjacent hair.

FIG. 9E shows a view of modeling channel 910 and hair profile 920 as were shown in FIG. 9D along with pile 922 measures. Like numbered elements in FIG. 9E are the same as so numbered elements in FIG. 9D. FIG. 9E also shows hair flow lines 921 that indicate how groupings of hair at scalp 903 may extend to hair profile 920. Hair flow lines 921 in FIG. 9E show hair emerging from scalp 903, rising upwards, and then curving to the right. Hair flow lines 921 terminate at hair profile 920. Each hair flow line 921 in FIG. 9E represents a collection or grouping of hair along modeling channel 910. Hair flow lines 921 are shown emerging from scalp 903 at regular intervals beginning one such interval from hair part 906 and emerging then at regular intervals along hair modeling channel 910 as hair modeling channel 910 extends to the right in FIG. 9E. Interval spacer lines 923 mark the intervals at which hair flow lines 921 emerge from modeling channel 910. Interval spacer lines 923 may be spaced at convenient intervals for various embodiments. In the embodiment of FIG. 9E, interval spacer lines 923 are spaced at intervals somewhat less than the width of modeling channel 910, but spacing interval spacer lines 923 according to the width of modeling channel 910 or at other suitable spacing for various embodiments is possible. Pile 922 is a measure of how many collections of hair defined as emerging from scalp 903 between interval spacer lines 923 are present vertically between each adjacent pair of interval spacer lines 923. Starting at the left in FIG. 9E, nearest to hair part 906, the first interval has a pile 922 measure of 1. The second interval has a pile 922 measure of 2. The third interval has a pile 922 measure of 3. The fourth interval has a pile 922 measure of 4. The fifth interval has a pile 922 measure of 5. The sixth interval has a pile 922 measure of 6. The seventh interval has a pile 922 measure of 6. The remaining pile 922 measures shown in FIG. 9E are all shown as 6, but other pile measures may be found for other embodiments of hair profiles 920, hair flow lines 921, and users 102. While only nine interval spacer lines 923 and nine hair flow lines 921 are shown in FIG. 9E, additional hair flow lines 921 and interval spacer lines 923 may be provided so that hair pile 922 measures may be provided over the full extent of hair modeling channel 910.

As shown and described in conjunction with FIG. 9E, pile 922 is a measure of how much hair is "stacked up" or "piled up" at a certain point along modeling channel 910. Pile 922 measures how many times hair from adjacent and nearby intervals along modeling channel 910 are combed over each other. If pile 922 is larger, hair height 505 under hair profile 920 may be larger. Layers of hair making up the stack or pile of hair leading to the definition of pile 922 as shown in FIG. 9E may be modeled differently from each other. For example, hair orientation factor will be explained with regard to FIG. 9F and weighting factors may be applied with regard to orientation factor for the various layers of hair making up pile 922. Orientation factor may be a stronger influence on hair near scalp 903, but a lesser influence to hair several layers "up the stack", so the effect of orientation on those layers may be weighted less strongly.

The definition of pile 922 in FIG. 9E demonstrates how some hair modeling parameters may change depending on how hair is to be cut. Hair flow lines 921 represent hair emerging from scalp 903 and extending to hair profile 920. If hair flow lines 921 are made longer to represent hair that is cut longer, then more hair will "pile up or stack up" in some hair intervals so that pile 922 will become larger. Hence, pile 922 is impacted by how hair is to be cut and, how a modeling algorithm determines hair should be cut is impacted by pile 922 modeling parameters. As will be explained with regard to FIGS. 10A-10D, how a hair modeling algorithm determines hair should be cut is at least partially determined by style preferences and not only so that hair profile 920 is met. Hence, situations regarding parameters, such as pile 922, that may be determined recursively, may be handled differently depending on the styling preferences that are being applied. Parameters that are part of recursive equations, recursive algorithms, or are otherwise recursively applied may or may not converge to acceptable results (if the recursive algorithm is not stable or is not otherwise convergent). Pile 922 must eventually converge acceptably if it is determined recursively so that the hair height equation may be utilized. For some embodiments of automated hair cutting systems, no actual hair cutting occurs until after hair is modeled. Hence, if convergence failures may be detected (by detecting the presence of extreme results, impossible results, prior known faulty convergence values, or detecting convergence failure in other possible ways), some embodiments of hair modeling algorithms may indicate failure so that other algorithms, techniques, modeling parameters, or other alternatives may be applied to achieve acceptable results, or so that user 102 may be notified of an erroneous situation before hair is cut in an undesirable way.

Pile 922 as shown in FIG. 9E and explained above relates to hair being assigned to intervals and pile 922 is a measure of how the intervals may be combed over each other and hair may stack up. Interval spacer lines 923 mark the intervals at which hair flow lines 921 emerge from modeling channel 910. Of course, how hair stacks up is also a function of the dimensions of the intervals used. As explained above, wider or narrower intervals may be applied. Narrower intervals may lead to larger measures for pile 922 as more intervals are considered, but each interval may then contain less hair. Hair height is then a function of both interval size and pile. The hair height equation, in some embodiments, may include a proportionality constant or other factor or term to account for interval width in addition to pile 922. Measures similar to pile 922 may be devised. For example, if hair thickness and length is known, how hair stacks up may be calculated on a continuous basis instead of using intervals and interval marker lines 923 as shown in FIG. 9E. Many similar measures to pile 922 may be derived and utilized in various embodiments.

Figure 9F:
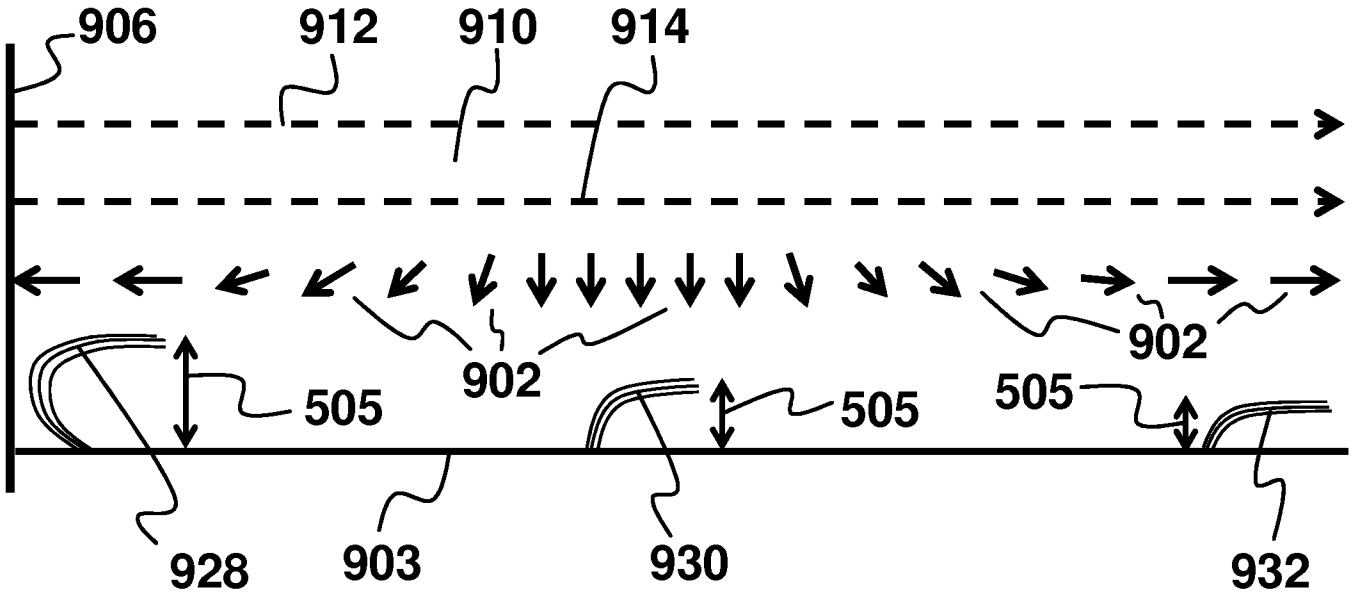
FIG. 9F is a view of a hair modeling channel along with hair orientation flow lines that allow the angle between the hair modeling channel and the hair orientation flow lines to be illustrated.

FIG. 9F shows a view of modeling channel 910 as was shown in FIG. 9D along with hair orientation flow lines 902. Like numbered elements in FIG. 9F are the same as so numbered elements in FIG. 9D. Hair orientation flow lines 902 as shown in FIG. 9F show the orientation of hair along the length of modeling channel 910 in a similar manner to how orientation flow lines 902 show hair orientation on scalp 903 in FIG. 9A. Hair orientation flow lines 902 shown in FIG. 9F would normally be substantially the same in the direction they point relative to hair modeling channel 910 with hair orientation flow lines 902 shown in FIG. 9A. Hair orientation flow lines 902 in FIG. 9F are different only in that they are shown as short segments versus the long hair orientation flow lines 902 shown in FIG. 9A. Several collections of hair are shown emerging from scalp 903 to illustrate the effect of hair orientation on hair height 505. First hair collection 928 is shown to the far left in FIG. 9F and shows a case where a local collection of hair is combed in the direction of the flow of hair modeling channel 910 and in which hair orientation flow lines 902 flow in the opposite direction. First hair collection 928 may be a small, local region of hair. As shown in FIG. 9F, first hair collection 928 is combed against the direction of orientation flow lines 902 near where it emerges from scalp 903 so that it folds back and upwards.

Referring back to FIGS. 9A-9C, hair part 906 is somewhat lower and to user's 102 right of the locations in FIG. 9A where hair begins to flow downwards along the right side of user's 102 head. Hence, the orientation flow lines 902 of FIG. 9F correctly show first hair collection 928 nearest hair part 906 flowing against the direction that hair will be combed along modeling channel 910. Second hair collection 930 emerges from scalp 903 and is combed along hair modeling channel 910 at substantially a right angle to the hair orientation flow lines 902 near where it emerges from scalp 903. Third hair collection 932 emerges from scalp 903 and is combed along hair modeling channel 910 substantially aligned to the hair orientation flow lines 902 near where it emerges from scalp 903. As shown in FIG. 9F, first hair collection 928 is combed folding back over itself and has the highest height 505, second hair collection 930 is combed at a right angle to its orientation and has medium height 505, and third hair collection is combed in the direction of its orientation and has the lowest height 505.

Some embodiments of hair modeling algorithms may include the effect of hair orientation and the angle that hair is combed to relative to its orientation. With regard to the hair height equation defined above, an orientation factor may be developed in a variety of ways. An example of one embodiment is:

$$\text{Orientation factor} = 2 - \text{COS}(\text{angle between hair orientation and combed hair flow})$$

In the equation above, the cosine of the angle between hair orientation and the flow of combed hair is taken. Note that with reference to FIG. 9F that this angle would be the angle between hair orientation flow lines 902 and the direction of the flow of modeling channel 910. The orientation factor as defined with the equation above would be equal to 3 for first hair collection 928 at the far left of FIG. 9F; would be equal to 2 for second hair collection 930 near the center of FIG. 9F; and would be equal to 1 for third hair collection 932 to the right side of FIG. 9F. The equation above for orientation factor is only one of many possible definitions and many modeling equations and algorithms may be applied that provide suitably accurate hair modeling based at least partially on the angle between hair orientation and the direction that hair is combed. Orientation factor may influence hair height 505 most strongly near to where hair emerges from scalp 903. Hence, hair that is some distance away from where it emerged from scalp 903 may have less weighting from orientation factor applied to it in some embodiments of hair height equations.

Figure 9G:
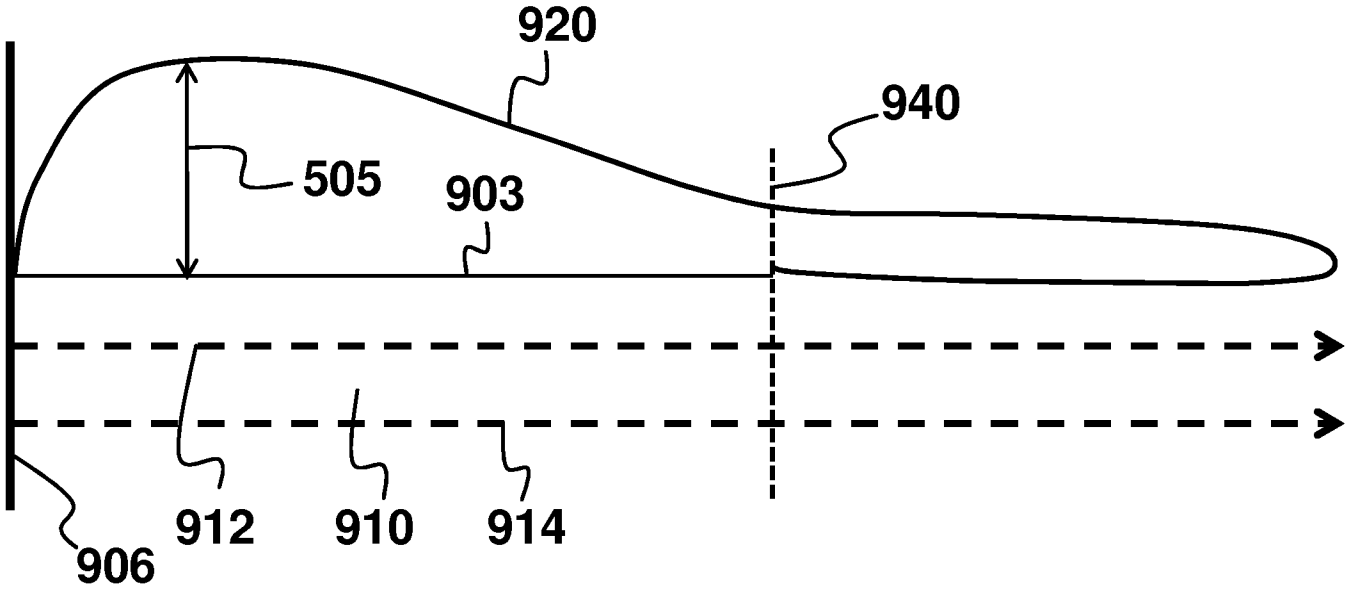
FIG. 9G is a view of a hair height profile taken across the head of the user shown in FIGS. 9A-9C that extends beyond the edge of the user's scalp so that the effect of the weight of hair pulling on the user's scalp may be illustrated.

FIG. 9G shows a view of modeling channel 910 as was shown in FIG. 9D along with a hair profile 920. Like numbered elements in FIG. 9F are the same as so numbered elements in FIG. 9D. Dashed line 940 in FIG. 9G shows the point where hair profile 920 extends beyond the scalp 903. The view shown in FIG. 9G is helpful for explaining the term "pull" that was introduced in the hair height equation defined above. Pull is the effect of the weight of hair extending beyond scalp 903, pulling on the hair over the scalp, causing the hair over the scalp to lay somewhat flatter and closer to scalp 903. That is, "pull" causes hair height 505 to be somewhat less than it would otherwise be. While the term "pull" or similar terms may be defined in many ways, one possible definition for and embodiment of pull is given by:

Pull=(mass of hair over a user's scalp in a modeling channel)/(total mass of user's hair in a modeling channel)

Accordingly, "pull" may be defined as a ratio of the mass of user's 102 hair in a modeling channel over their scalp to the mass of all of their hair in that modeling channel 910 (and the modeling channel 910 extends in such a case to the full length of the hair as shown in FIG. 9G). Note that, with this definition, "pull" would always be less than or equal to one. Hence, users 102 with long hair would have lower hair height 505 than if their hair were cut shorter. Many similar or equivalent measures of "pull" may be defined and utilized for various embodiments of hair modeling algorithms. For example, an alternative embodiment of "pull" may be defined as hair height 505 divided by the length of hair along the modeling channel 910 so that longer hair near part 906 may have a different "pull" factor applied to it versus shorter hair emerging from scalp 903 nearer to dashed line 940 (which marks the edge of scalp 903). Many ways to measure and/or model the effect of the weight of hair pulling on and possibly compressing hair may be devised and utilized in various embodiments.

Using the hair height equation provided above for hair height 505 and the hair modeling parameters described with regard to FIGS. 9A-9G, it is possible to explain how a hair modeling algorithm may use input from user 102 operating a user interface for automated hair cutting system 100 and generate an output for how hair is to be cut along a hair modeling channel 910. As previously described, once it is determined how to cut, thin, or otherwise style hair along a hair modeling channel, interpolation techniques and other common approaches may be used to generate a map for hair cutting, hair thinning, and other possible hair styling effects that are to be applied over scalp 903.

Figure 10A:
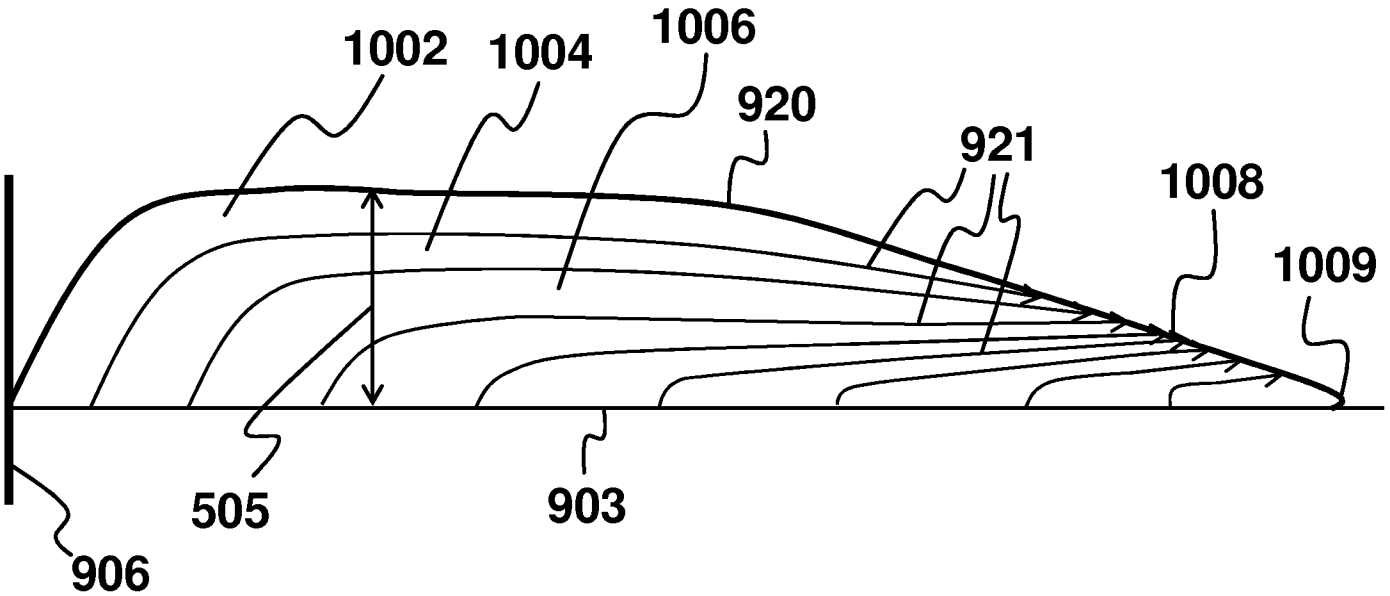
FIG. 10A is a view of another hair height profile taken across the head of the user shown in FIGS. 9A-9C illustrating how hair may be cut in a smooth textured style.

In FIG. 10A, hair profile 920 is shown that may have been generated by user 102 using a software tool on electronic computing device 110 or some other possible electronic user interface. Hair profile 920 may have been generated using translation controls 412 as shown, for example, in FIG. 9D or other possible editing controls. Hair profile 920 represents hair height 505 over a hair modeling channel such as hair modeling channel 910. Hair flow lines 921 begin at scalp 903 and terminate at hair profile 920. Each hair flow line 921 represents a collection or grouping of hair along a hair modeling channel as was described with regard to FIG. 9E. Scalp edge 1009 marks the edge of scalp 903 furthest from hair part 906 and is the point where the hair modeling channel ends if no hair is to extend beyond the scalp edge 1009, which is the case for the embodiment of FIG. 10A. Beginning at hair part 906 and working from there to the right, first hair interval 1002, second hair interval 1004, and third hair interval 1006 represent the hair between their adjacent hair flow lines 921 (in the case of first hair interval 1002, it represents the hair between hair profile 920 and its adjacent hair flow line 921). Tapered hair 1008 is found near scalp edge 1009 and represents hair near the bottom edge of scalp 903.

How hair is cut, thinned, or styled along a hair modeling channel is a function of the desired hair style user 102 is seeking to achieve. FIG. 10A shows an embodiment of a hair style in which hair nearest to hair part 906 is kept as long as possible and is allowed to flow almost completely from hair part 906 to the far edge of the scalp 903 near tapered hair 1008. The styling effect desired from the embodiment of FIG. 10A may be to create a smooth and flowing look where hair beginning at hair part 906 flows smoothly over user's 102 head as far as possible. A hair modeling algorithm seeking to produce the style of FIG. 10A may start with first hair interval 1002 and allow that hair to flow as far as possible over user's 102 head, possibly allowing it to extend to scalp edge 1009 or tapering it near tapered hair 1008 in the vicinity of scalp edge 1009. Such a modeling algorithm may subsequently move to second hair interval 1004 and third hair interval 1006 and also allow hair in those intervals to flow over user's 102 head as much as possible. From FIG. 10A, as more hair intervals are analyzed, that eventually there may be too much hair under hair profile 920 so that the desired hair height 505 is exceeded. To bring hair profile 920 back down to meet the profile desired by user 102, the hair modeling algorithm may thin hair using hair thinning techniques that are possible with automated hair cutting system 100. Hair thinning may be avoided near hair part 906 and may be preferentially applied for hair intervals further from hair part 906 so that hair in first hair interval 1002 and other hair intervals nearest to hair part 906 extend as long and thick as possible to preserve the desired objectives for the embodiment of the hair style shown in FIG. 10A. However, in other embodiments, hair may be thinned more uniformly over the hair modeling channel to meet hair profile 920. As previously noted, many alternative hair modeling algorithms may be applied with various approaches to how hair may be modeled so that various styling effects may be achieved.

Figure 10B:
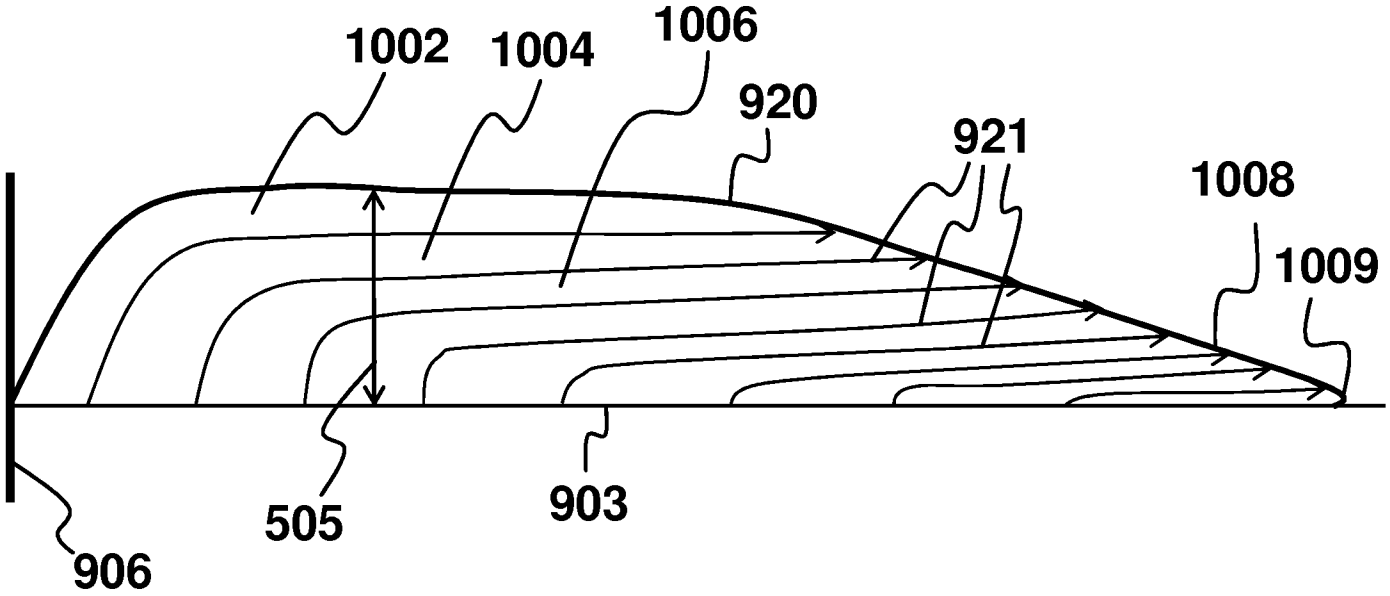
FIG. 10B is a view of yet another hair height profile taken across the head of the user shown in FIGS. 9A-9C illustrating how hair may be cut in a layered hair style.
Figure 10C:
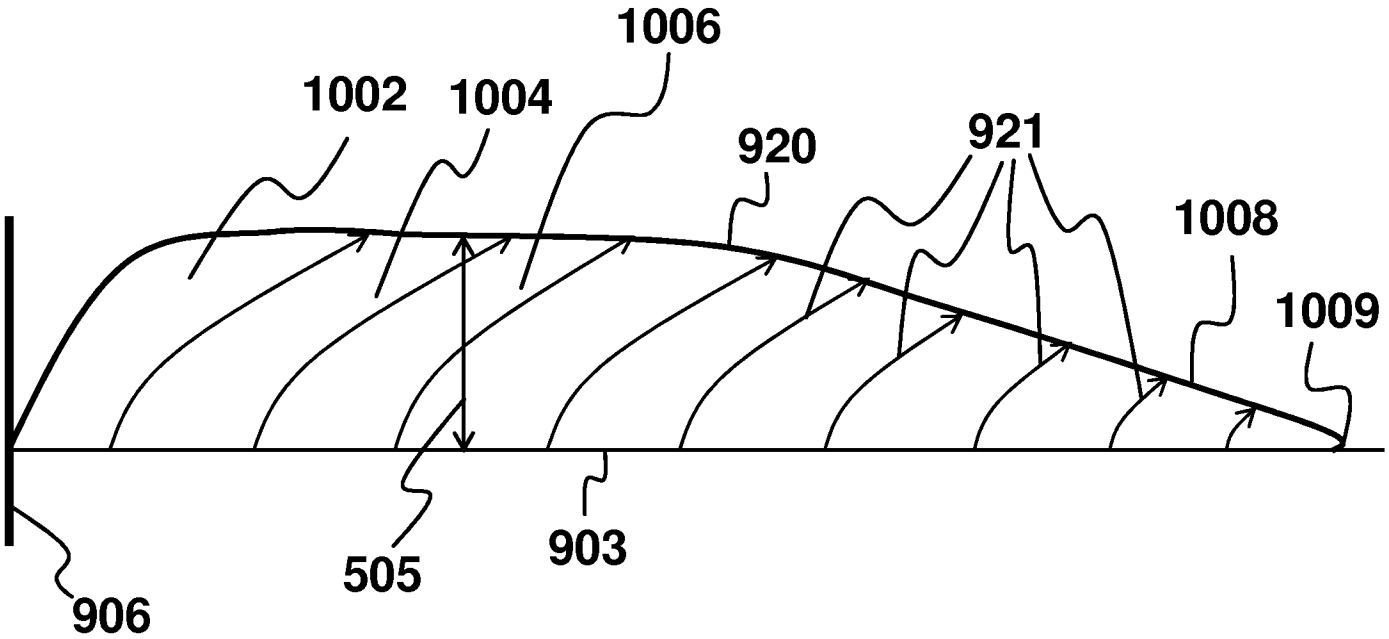
FIG. 10C is a view of still another hair height profile taken across the head of the user shown in FIGS. 9A-9C illustrating how hair may be cut in a feathered hair style.
Figure 10D:
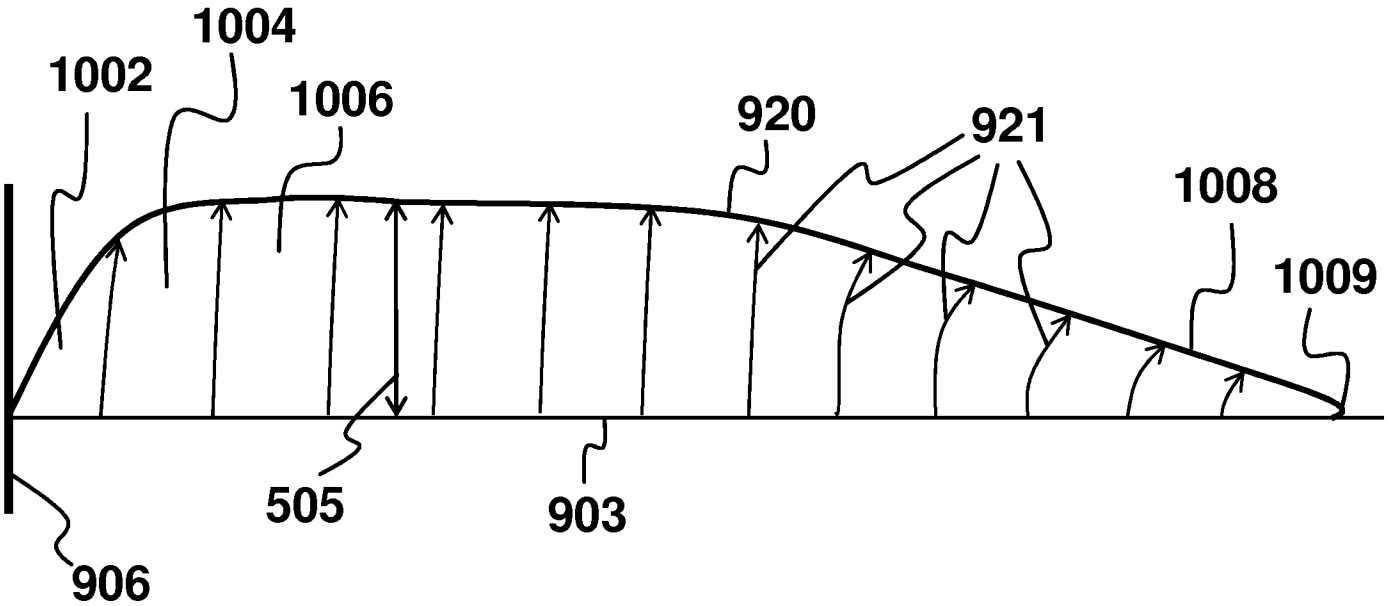
FIG. 10D is a view of yet another hair height profile taken across the head of the user shown in FIGS. 9A-9C illustrating how hair may be cut in a spiked style.

The embodiments of FIGS. 10B-10D are made up of the same elements as the embodiment of FIG. 10A and numbered elements in FIGS. 10B-10D are the same as those so numbered in FIG. 10A. FIGS. 10B-10D provide embodiments of different hair styles that may be achieved by hair modeling algorithms. FIG. 10B shows a hair style in which hair is layered so that hair in first hair interval 1002 extends part way across user's 102 scalp and hair in second hair interval 1004 extends beyond it. A layered hair style such as that shown in FIG. 10B may be desirable for some users as hair in the longer hair intervals that begin near hair part 906 is cut to substantially similar length. Hair in first hair interval 1002, second hair interval 1004, third hair interval 1006, and additional nearby hair intervals may be of similar length. Keeping longer hair on user's 102 head to similar length may keep hair looking better if it gets messed up or is not perfectly combed (since the hair is of similar length, it matters less which way it is combed versus styles where hair changes length significantly from one hair interval to the next). A hair modeling algorithm seeking to produce the embodiment of FIG. 10B may begin by assuming all hair on user's 102 head is to be cut to the same length. The length used may be chosen conveniently as some percentage of the size of user's 102 head, a fixed length, a length entered by user 102 into electronic computing device 110, or some suitable length chosen in another fashion. Hair may then be modeled in the hair modeling channel represented by FIG. 10B and hair in intervals near tapered hair 1008 and scalp edge 1009 may be shortened to meet hair profile 920. If hair height 505 along hair profile 920 is exceeded, hair may be thinned at some locations so that hair profile 920 is substantially met. User interface may provide user 102 with options for whether hair is to be thinned to meet hair profile 920, if alternatively the user wishes to cut their hair somewhat shorter instead, or if user 102 may wish to modify hair profile 920 in the course of modeling hair. An algorithm where a processor collects initial user inputs, models hair, provides results, seeks additional user inputs, models hair again and provides new results, and repeats in a recursive manner until results are created that the user approves, may be utilized in some embodiments.

The embodiment of FIG. 10C provides a feathered or textured look over much of user's 102 head by cutting hair so that hair ends are somewhat more visible. Hair in first hair interval 1002, second hair interval 1004, and the other hair intervals are cut some fixed percentage longer than hair height 505 based on where they lie along the hair modeling channel. For example, hair may be uniformly cut to twice hair height 505 for each hair interval (note that hair height 505 is much less near tapered hair 1008 and scalp edge 1009 and hair in those regions would be also be cut to twice hair height 505, but results in much shorter hair where hair height 505 is shorter).

Other ratios or percentages for cutting hair versus hair height are possible and may be input by user 102 into electronic computing device 110 or may be chosen in other ways. Once the ratio for cutting hair relative to hair height 505 is chosen, hair height may be modeled and the length of some hair near tapered hair 1008 and scalp edge 1009 may need to be adjusted by the modeling algorithm to somewhat shorter length. Hair may also be thinned at various locations along the modeling channel so that hair profile 920 is met. For feathered hair such as the embodiment of FIG. 10C, it may also be desired to randomize hair length somewhat so that the cut hair includes a desirable texture or finish. Hair length may be randomized through appropriate operation of cutter head 200 in the course of cutting hair.

The embodiment of FIG. 10D provides spiked hair style by cutting hair to lengths similar to hair height 505 over much of user's 102 head. As shown in FIG. 10D, some hair such as hair near tapered hair 1008 and scalp edge 1009 may be left somewhat longer than hair height 505 (under hair profile 920), but it is also possible to simply cut all the hair on user's 102 head to fit profile 920 by directly cutting all hair to the hair height 505 for its location under profile 920. Spiked hair may be styled with hair styling gel and may be formed into spikes to provide a desired style. Some users 102 with rather thick hair may need to thin their hair so that spikes may be formed. Hair modeling algorithms with information on the length of hair spikes to be formed and the thickness of user's hair may automatically provide hair thinning so that desired results are produced. Using automated hair cutting system 100, hair may be thinned in desired ways to create patterns of thinner and thicker hair over user's 102 head. Hair may also be thinned along its length so that hair on user's 102 head is thicker near the scalp 903 and thinner near hair profile 920. Patterns of thinner and thicker hair, and hair thinned to various levels along its length may allow users 102 to create specialized styles and effects. Hair height 505 for spiked hair may refer to the length of the longest hair after cutting is completed, but thickness of hair various distances above scalp 903 may vary for various styling effects.

While FIG. 10D shows spiked hair, the concept of hair combing flow lines 904, such as first hair combing flow line 912 and second hair combing flow line 914 as shown in FIG. 9C, preparing a hair cutting algorithm may require additional inputs from components of automated hair cutting system, since spiked hair may not be combed in a lateral fashion as was assumed in defining hair combing flow lines 904. For spiked hair or other possible hair styles that do not involved combing hair substantially laterally over scalp 903, hair modeling channels may be defined according to a grid pattern, preferred flow patterns, the pattern of hair orientation flow lines 902 (as shown in FIG. 9A), or in other possible ways. The absence of actual combing flow lines for some hair styles is not a limitation in determining and modeling hair along hair modeling channels, and for such cases, hair modeling channels need only be defined in alternative ways.

For spiked hair, there is no difficulty for a hair modeling algorithm to determine how long hair should be cut to meet hair profile 920. So while hair height 505 and hair profile 920 may be important inputs in modeling spiked hair and determining how it should be cut, other hair modeling parameters such as hair thickness, hair thickness as a function of distance above scalp 903, and other possible parameters may also be important. Hence, for some hair styles, hair height 505 along a profile 920 may be only one of several parameters of interest that may be modeled and may impact how hair may be eventually cut.

Some embodiments may show some or all of the views shown and described herein to allow user 102 to understand how a hair modeling algorithm works and to allow user 102 to make modifications to their hair and interact with user interface and hair modeling algorithm to produce desirable results. The views shown in the figures of the present disclosure, other views, and similar views to the views shown in the present disclosure may be used in various embodiments of user interfaces for automated hair cutting systems to allow a user or other persons to view, edit, model, customize, combine, visualize, or otherwise work with or benefit from them.

The embodiments of FIGS. 10A-10D provide only a few examples of possible embodiments of hair modeling algorithms that may be utilized with a few examples of hair styles. A wide variety and number of hair styles may be provided and users may customize styles to produce hair styles that suit them individually. As shown in FIGS. 10A-10D, some hair styles may use specialized approaches to hair modeling and may invoke somewhat different hair modeling approaches or algorithms to achieve desired results.

Further, different hairstyles may require different inputs and parameters for preparing an algorithm for cutting hair for the automated hair cutting system 100. While the embodiments shown and described herein have illustrated receiving inputs from the user and various components of an automated hair cutting system to prepare an algorithm for cutting hair using the parameters of hair height, hair texture, thickness, and mass, additional embodiments may utilize additional and/or other parameters. Accordingly, the user interface may provide an interface for additional programming and configurations of the components of cutter head 200 and cutting device 120 and other components of hair cutting system 100 such that the additional parameter may be measured or determined. Accordingly, a processor comprising the user interface may be configured to prepare additional algorithms for additional hair styles, head types, and various additional factors. Various constants, offsets, factors, adjustments, calibrations, etc. may be applied to hair modeling algorithms so that users may achieve results in their actual hair that are sufficiently similar to what they observe in the results of hair modeling tools and user interfaces.

Some hair styles involve additional steps beyond hair cutting to achieve the desired style, including application of styling products, curling, and/or various other styling tools. Some embodiments may be configured to direct the user accordingly, or to direct a human hairstylist attending to user with instructions for completing the desired style.

While the embodiments of user interface are shown and described herein in conjunction with automated hair cutting system 100, some embodiments may interface with the user separately and independently of automated hair cutting system 100 for various uses, such as modeling of hair, fitting of hair styles to various users, recommending products to users, and other benefits for users that do not include use of an automated hair cutting system.

Some embodiments of interfaces for automated hair cutting system 100 may also be configured to provide entertainment such as music, games, and the like. For example, when providing children's haircuts, electronic computing device 110 may intersperse information and instructions to a parent cutting a child's hair with electronic games, videos, and other entertainment for the child.

Those skilled in the art to which the present disclosure relates will appreciate that other and further additions, deletions, substitutions, and modifications may be made to the describe embodiments.

The invention claimed is:

1. An electronic computing device for use with an automated hair cutting system, comprising:

an electronic processor configured to perform computations;

a user interface for providing information to and receiving input from a user, wherein at least one input received from the user is a desired hair style;

an interface to a movable component of the automated hair cutting system, the movable component configured to be held and manipulated by the user, the automated hair cutting system determining a position of the movable component relative to the head of the user, the movable component comprising a plurality of comb teeth configured to engage at least a portion of the user's hair, and wherein the movable component, at some points in time in coordination with manipulation of the movable component by the user, applies force to at least a first subset of the plurality of comb teeth and monitors the position of at least a second subset of the plurality of comb teeth, and wherein the automated hair cutting system utilizes at least one of said position of the movable component and said position of at least a second subset of the plurality of comb teeth to determine, for at least one region of the user's scalp, at least one of the user's hair length, hair thickness, and hair orientation; and an algorithm operating on the electronic computing device or operating on another computer interfaced to the electronic computing device, the algorithm at least partially responsive to at least one of said hair length, said hair thickness, and said hair orientation, the algorithm configured to provide at least an indication of the height to which hair extends above the user's scalp for at least one location on the user's scalp.

2. The electronic computing device according to claim 1, wherein the user interface comprises an interactive touch screen display.

3. The electronic computing device according to claim 1, wherein the algorithm is further configured to prepare a mapping of length to which hair is to be cut as a function of location on the user's head for at least a portion of the user's head to at least approximately provide said desired hair style once hair is cut to said mapping of length, and wherein the algorithm is at least partially responsive to a desired hair height above the user's scalp as input to the electronic computing device by the user for at least one location on the user's scalp.

4. The electronic computing device according to claim 1, wherein the algorithm is further configured to notify the user, via the user interface, if the determined at least one of the user's hair length, hair thickness, or hair orientation for the user is incompatible with the user's desired hair style.

5. The electronic computing device according to claim 1, wherein the user interface is configured to allow the user to make modifications to the desired hair style.

6. The electronic computing device according to claim 1, wherein the user interface is further configured to provide styling instructions to the user for completing the desired hairstyle, said styling instructions to occur upon conclusion of hair cutting by automated hair cutting system.

7. The electronic computing device according to claim 1, wherein the user interface is configured to recommend hair care products to the user based on at least the user's desired hair style.

8. The electronic computing device according to claim 1, wherein at least a subset of the comb teeth include both sharp and dulled edges.

9. An electronic computing device for use with an automated hair cutting system, comprising:

an electronic processor configured to perform computations;

a user interface for providing information to and receiving input from a user; and an interface to a movable component of the automated hair cutting system, the movable component configured to be held and manipulated by the user, the automated hair cutting system determining a position of the movable component relative to the head of the user, the movable component comprising a plurality of comb teeth configured to engage at least a portion of the user's hair;

and wherein, for at least one possible mode of operation of the automated hair cutting system, the movable component is configured to monitor the quantity of hair in the cutter head as the movable component is manipulated to slidingly extend hair through the cutter head, to measure the length of the user's hair, for at least one region of the user's scalp;

and wherein the electronic computing device provides recommendations regarding hair styles to the user based at least partially on said length of the user's hair.

10. A user interface for an automated hair cutting system, comprising:

a display configured to provide information to a user;

an input interface configured to receive input from the user; and a processor in data communication with the input interface and the display, the processor configured to:

communicate with a movable component of the automated hair cutting system, the movable component configured to be held and manipulated by the user, the automated hair cutting system determining a position of the movable component relative to the head of the user, the movable component comprising a plurality of comb teeth configured to engage at least a portion of the user's hair, and wherein the movable component, at some points in time in coordination with manipulation of the movable component by the user, applies force to at least a first subset of the plurality of comb teeth and monitors the position of at least a second subset of the plurality of comb teeth, to determine, for at least one region of the user's scalp, at least one of the user's hair length, hair thickness, and hair orientation;

receive input from the input interface regarding a hair style;

provide information on the display regarding the hair style; and prepare hair cutting instructions for the automated hair cutting system, the hair cutting instructions at least providing a mapping of length to which hair is to be cut as a function of location on the user's head for at least a portion of the user's head.

11. The user interface according to claim 10, wherein the display comprises an interactive touch screen.

12. The user interface according to claim 10, wherein the input interface comprises a personal computing device.

13. The user interface according to claim 10, wherein the processor is further configured to receive input from the input interface providing an indication of at least one of degree of hair stiffness and degree of hair curl.

14. The user interface according to claim 13, wherein the processor is further configured to adjust the hair cutting instructions for the automated hair cutting system based on at least one of degree of hair stiffness and degree of hair curl.

15. The user interface according to claim 10, wherein the display is further configured to provide styling instructions to the user for completing the desired hairstyle, said styling instructions to occur upon conclusion of hair cutting by automated hair cutting system.

16. The user interface according to claim 10, wherein the display is configured to recommend hair care products to the user based on at least the user's desired hair style.

17. An automated hair cutting system, comprising:

a hair cutting device, the hair cutting device comprising a cutter head, the cutter head configured to be controllable to both cut hair, and to engage hair so that hair may slide through at least a portion of the cutter head, the hair cutting device configured to control the cutter head cooperatively with position of the hair cutting device, to measure at least one of a user's hair length, hair thickness, and hair orientation;

at least one sensor, the sensor configured for at least partially determining position of the hair cutting device;

a user interface configured to provide information to and to receive input from the user, wherein at least one input received from the user is a desired hair style; and a processor in data communication with both the user interface and the hair cutting device, the processor configured to prepare hair cutting instructions for the automated hair cutting system based, at least partially, on input received from the user interface, and from the hair cutting device, the instructions at least providing a mapping of length to which hair is to be cut as a function of location on the user's head for at least a portion of the user's head.

18. The system according to claim 17, wherein the user interface comprises an interactive touch screen.

19. The system according to claim 17, wherein the user interface comprises a display.

20. The system according to claim 17, wherein the cutter head comprises cutter knives and comb teeth, each including both rounded and sharp edges, and wherein at least a subset of the sharp edges are configured to pass by each other, so that hair between them may be cut, when said cutter head is controlled to cut hair.

21. The system according to claim 17, wherein the user interface is further configured to provide styling instructions to the user for completing the desired hairstyle, said styling instructions to occur upon conclusion of hair cutting by automated hair cutting system.

22. The system according to claim 17, wherein the user interface is configured to recommend hair care products to the user based on at least the user's desired hair style.

* * * * *